US010899507B2

(12) United States Patent
Macrellino

(10) Patent No.: US 10,899,507 B2
(45) Date of Patent: Jan. 26, 2021

(54) CAP AND CONTAINER FOR CARBONATED DRINKS

(71) Applicants: DrinkStation, Inc., Torrance, CA (US); PepsiCo, Inc., Purchase, NY (US)

(72) Inventor: Diego Macrellino, Torrance, CA (US)

(73) Assignees: PepsiCo, Inc., Purchase, NY (US); DrinkStation, Inc., Torrance, CA (US)

( * ) Notice: Subject to any disclaimer, the term of this patent is extended or adjusted under 35 U.S.C. 154(b) by 45 days.

(21) Appl. No.: 16/416,001

(22) Filed: May 17, 2019

(65) Prior Publication Data

US 2020/0361669 A1 Nov. 19, 2020

(51) Int. Cl.
*B65D 47/12* (2006.01)
*B65D 81/18* (2006.01)

(52) U.S. Cl.
CPC ..... *B65D 47/121* (2013.01); *B65D 81/18* (2013.01)

(58) Field of Classification Search
CPC ..... A47G 19/12; A47G 19/14; A47J 31/00; B65B 3/02; B65B 3/04; B65B 3/06; B65D 25/00; B65D 25/40; B65D 47/04; B65D 47/043; B65D 47/121; B65D 81/18
USPC ..... 215/307, 355, 363
See application file for complete search history.

(56) References Cited

U.S. PATENT DOCUMENTS

| | | | |
|---|---|---|---|
| 3,256,916 | A | 6/1966 | Silletti |
| 6,234,223 | B1 | 5/2001 | Nelson |
| 2006/0022000 | A1 | 2/2006 | Boggs et al. |
| 2012/0241453 | A1 | 9/2012 | Palmer |
| 2013/0019990 | A1 | 1/2013 | Clark et al. |

OTHER PUBLICATIONS

International Search Report and Written Opinion of the International Searching Authority in International Application No. PCT/US2020/033165, dated Jul. 28, 2020 (7 pages).

*Primary Examiner* — James N Smalley
*Assistant Examiner* — Madison L Poos
(74) *Attorney, Agent, or Firm* — Sterne, Kessler, Goldstein & Fox P.L.L.C.

(57) ABSTRACT

A cap and container reduce carbonation loss in filling containers with carbonated beverages. The cap has a splashguard with a circular bottom connected by a conical transition to a smaller diameter, cylindrical ring portion. A circular dispersing disk is above the transition and connected to the cap, with a small radial gap between the disk's periphery and the splashguard. A fluid seal is interposed between the ring portion and an open top of the container. The dispersing disk directs a fluid stream outward against the splashguard where the fluid passes through the radial gap around the disk and flows downward in a laminar flow over the conical transition and ring portions. A lip on the bottom of the ring portion extends outward and downward to conduct the laminar flow onto the container sidewall, which is inclined at less than five degrees to maintain laminar flow along the sidewall when filling.

27 Claims, 19 Drawing Sheets

CAP AND CONTAINER FOR CARBONATED DRINKS

BACKGROUND

Carbonated beverages are sold in single-serving bottles or cans, or larger containers in liter sizes, or larger. The carbonated beverages are usually served directly from the container in which they are purchased. The larger containers of carbonated beverages may be poured into conventional pitchers for and dispensed from the pitchers, but doing so causes the beverage to lose carbonation. There is thus a need for an improved dispenser and container for carbonated beverages that reduces loss of carbonation when being filled.

Further, an open top pitcher allows carbonation to be lost as the beverage sits in the pitcher. If a closure is provided on the pitcher to reduce loss of carbonation, the closure makes it difficult to access and clean the inside of the container. There is thus a need for a container and closure that reduces loss of carbonation while allowing easy cleaning of the container and/or closure. The pitcher and carbonated beverage bottle can be tilted relative to each other and the beverage poured into the pitcher slowly to try and reduce splashing and loss of carbonation, but not all consumers have the coordination and strength to do so, and the liquid often pours from the initial bottle in spurts which increases splashing and loss of carbonation. There is thus a need for a container and closure that allows a faster filling while reducing loss of carbonation from personal sized and larger, liter-sized bottles of beverages, and while freeing the user from holding the container or dispersing bottle tilted.

Some commercial or home drink dispensers allow users to push a button and have various beverages dispensed from a spigot, including carbonated beverages. When conventional pitchers are filled from such drink stations and spigots, carbonation is lost from the splashing and turbulent flow that occurs when the pitchers are filled with carbonated beverages from the drink station. The pitcher can be tilted to one side and the beverage dispensed into the pitcher to try and reduce splashing and loss of carbonation, but that requires holding the pitcher correctly during the time it is filled, and not all users have the time or the coordination or the strength to do so successfully, especially as the pitcher fills and becomes heavier. There is thus a need for an improved beverage container and closure that allows filling with carbonated beverages from dispenser spigots while reducing the loss of carbonation and while freeing the user from holding the container tilted.

In commercial establishments, workers will dispense carbonated beverages from a spigot by setting the container below the spigot, opening the spigot and walking away to perform other tasks until a volume is dispensed and the spigot is shut off automatically or by the worker. But that dispenses the stream of carbonated beverage a large distance and onto a surface (cup or pitcher bottom or liquid surface) that encourages splashing and loss of carbonation. There is thus a need for an improved container and closure for commercial dispensers of beverages to fill containers with carbonated beverages while reducing loss of carbonation and while freeing workers from having to hold the container tilted.

When large pitchers are filled with a carbonated beverage from a fixed location spigot, the beverage must fall a longer distance from the spigot to the bottom of the empty pitcher and that causes an increase in the velocity of the beverage stream and a resulting increase in splashing and loss of carbonation. Thus, larger and taller containers lose more carbonation when they are filled than do smaller containers. There is thus a need for an improved container and closure that reduces loss of carbonation for larger or taller containers.

BRIEF SUMMARY

A cap and container are provided to reduce carbonation loss when filling containers with carbonated beverages, and they will also work with non-carbonated beverages. The cap has a splashguard with a pouring spout and a circular bottom that is connected by a conical transition to a smaller diameter, cylindrical ring portion at the bottom of the cap. A circular dispersing disk is located above the transition and connected to the cap, with a small radial gap between the disk's periphery and the bottom of the splashguard. A fluid seal is placed between the outer surface of the ring portion and an open top of the container to provide a fluid seal between the cap and the container. The dispersing disk directs a fluid stream outward against the splashguard where the fluid passes through the radial gap around the disk and flows downward in a laminar flow over the conical transition and ring portions. A lip on the bottom of the ring portion extends outward and downward to conduct the laminar flow onto the container sidewall, which is inclined at less than five degrees to maintain laminar flow along the sidewall when filling. It is believed that the laminar flow can be maintained at flow rates of up to gpm for carbonated water, and for even higher flow rates for more viscous or syrupy fluid such as carbonated sodas or beer.

There is thus advantageously provided an apparatus for receiving a fluid in, and dispensing that fluid from, a container that extends along a longitudinal axis and has a container lip defining a container opening at a top of the container. The container has a closed container bottom. The apparatus comprises a cap having a laminar flow path through a lower portion of the cap. The cap advantageously includes a splashguard at a top end of the cap, with the splashguard encircling the longitudinal axis during use. The cap further has a ring portion at a bottom end of the cap. The ring portion has a bottom lip extending outward and downward from the bottom of an inward facing flow surface. The ring portion also has a top connected to a bottom of the splashguard. The bottom lip, flow surface and top of the ring portion all encircle the longitudinal axis and form a portion of the laminar flow path. The cap further has a continuous dispersing disk inside the splashguard and connected to the cap. The dispersing disk is above the connection of the splashguard with the top of the ring portion and faces upward. The disk has an outer disk periphery spaced a radial distance of 2 and 5 mm from the splashguard and spaced an axial distance of 4 to 10 mm above the top of the ring portion so the fluid can flow from the dispersing disk at flow rates of up to 1.5 gpm and even 2 gpm outward to the splashguard during use, with a substantial portion of the fluid flowing in a laminar flow downward across the connection of the splashguard and the ring portion and across the bottom lip. The cap also has a ring seal connected to the cap and having a shape and size corresponding to that of the container opening, to contact and seal against the container opening during use.

In further variations of this apparatus, the inward facing flow surface of the ring portion is cylindrical and coaxial with the longitudinal axis, and the connection between the ring portion and the splashguard comprises a conical section while the splashguard has a circular cross-section in a plane orthogonal to the longitudinal axis at the location of the dispersing disk. This is believed to facilitate laminar flow. The dispersing disk ma have a flat surface, or it may have a shaped protrusion on the upper surface of the dispersing disk with a cross-sectional diameter that decreases in a downward direction to direct the flow of fluid flowing downward along the longitudinal axis in an outward direction around a majority of the dispersing disk. Advantageously, the dispersing disk is connected to the cap by a plurality of supports extending from the ring portion to the dispersing disk. The splashguard may include a pouring spout and advantageously part of the sidewall is inclined outward to form an inclined pouring spout.

In still further variations, the apparatus may include the container with the seal placed in the opening of the container. The container advantageously has a sidewall extending along the longitudinal axis, and encircling that axis, with the sidewall increasing in cross-sectional area along a majority of the length between the container opening and the bottom of the container. The container sidewall(s) are advantageously inclined outward at an angle to the vertical of less than 5°, so the bottom of the container is larger than the top of the container. The lip and bottom of the seal form a portion of a laminar flow path extending through the cap and into the container.

The cap and container may also advantageously form a kit. The kit may include any of the caps described herein, and any of the containers described herein. Advantageously, the container has a sidewall extending along the longitudinal axis, with the sidewall increasing in cross-sectional area along a majority of the length between the container opening and the bottom of the container so the bottom is larger than the top. The container sidewall is advantageously inclined at an angle to the vertical of less than 5°, with the lip and bottom of the seal forming a portion of a laminar flow path when the cap is placed on the container and the seal is placed in the container opening to seal that opening.

In a further embodiment, there is provided another apparatus for receiving a fluid in, and dispensing that fluid from, a container that extends along a longitudinal axis. This container also has a container lip defining a container opening at a top of the container opposite a closed container bottom. This further apparatus comprising a cap that includes a splashguard, a ring portion, a dispersing disk and a seal. The splashguard is at a top end of the cap and encircles a majority of the longitudinal axis during use. The ring portion has a bottom lip at a bottom end of the cap. That bottom lip extends outward and downward, with the ring portion and bottom lip encircling the longitudinal axis during use. The dispersing disk is connected to the cap and is located above the ring portion and inside the splashguard. The dispersing disk has an outer disk periphery in a plane orthogonal to the longitudinal axis which disk periphery is spaced a distance from the splashguard of between 2 and 5 mm so the fluid can flow from the dispersing disk to the splashguard and downward along the splashguard and through the ring portion. The ring seal is connected to an outward facing side of the cap and preferably connected to an outward facing side of the ring portion. The ring seal has a shape corresponding to that of the container opening and is sized to contact and seal against the container opening during use. Thus, if the container opening is circular or oval, the ring seal shape is circular or oval, and if the container opening is square or hexagonal with rounded corners then the ring shape is square or hexagonal with rounded corners.

In further variations of the apparatus, the dispersing disk has a shaped protrusion extending upward along the longitudinal axis, and preferably the shaped protrusion has a cross-section in a plane orthogonal to the longitudinal axis that is smaller at the top and larger at the bottom to redirect a stream of fluid moving downward along the longitudinal axis, outward toward the outer periphery of the dispersing disk. The dispersing disk may also advantageously have a shaped protrusion extending upward and forming a circle of revolution that directs fluid flowing downward along the longitudinal axis to move in an outward direction and has a cross-section in a plane orthogonal to the longitudinal axis that is smaller at the top and larger at the bottom. In still further variations, the dispersing disk may have an upward facing surface that is flat, and that is preferably circular or whatever other shape corresponds to the shape of the container opening.

In other variations, the portion of the cap below the bottom of dispersing disk is advantageously configured to cause laminar flow of carbonated water having no dissolved sugar, at a flow rate of up to 1.5 to 2 gpm across a major portion of the ring portion in the downward direction. The same laminar flow preferably also using distilled water at room temperature. Advantageously the portion of the cap below the bottom of dispersing disk is configured to cause laminar flow of distilled water, and preferably of carbonated water having no dissolved sugar, at a flow rate of up to 1.5 to 2 gpm across a substantial majority of the ring portion in the downward direction, and more preferably achieves laminar flow across a substantial portion of the ring portion in that downward direction. In still further variations, the splashguard may include a pouring spout and advantageously the splashguard forms the sides of the spout.

Advantageously a substantial majority of the splashguard that is radially outward and downward of the dispersing disk is cylindrical and the ring portion has a cylindrical inward facing surface that is the same diameter as that substantial majority of the splashguard. Thus, the splashguard and ring portion are cylindrical. The splashguard may alternatively have a bottom shoulder extending inward and downward and wherein the ring portion has an upper shoulder extending outward and upward to connect with the bottom shoulder of the splashguard, the ring portion having an inward facing surface that is radially inward of the outer periphery of the dispersing disk. The portion of the cap below the bottom of dispersing disk is preferably configured to cause laminar flow of a carbonated beverage at a flow rate of up to 1.5 to 2 gpm across a majority, and preferably across a substantial majority of the ring portion in the downward direction.

In other variations, the cylindrical, inward facing surface is below the top surface of the dispersing disk an axial distance of between 5 to 15 mm, measured at the outer periphery of the dispersing disk. The splashguard may have a bottom shoulder extending inward and downward and the ring portion may have an upper shoulder extending outward and upward to connect with the bottom shoulder of the splashguard, with the ring portion having an inward facing surface that is radially inward of the outer periphery of the dispersing disk. The ring portion may have an inward facing surface that is cylindrical, that is located radially inward of the outer periphery of the dispersing disk a distance of 1 mm to 10 mm, and that is below the top surface of the dispersing disk at the outer periphery of that disk an axial distance between 5 to 15 mm.

The ring seal preferably comprises four annular flanges extending outward from an inner wall of the sealing ring. The four annular flanges include, and preferably consist of top and bottom flanges on opposing ends of the ring seal, a first intermediate flange that is adjacent the bottom flange, and a second intermediate flange extending radially outward while the top, bottom and first intermediate flange extend outward and upward. Advantageously, the first and second flanges extend upward at an angle of substantially 100 and extend radially outward a distance that is 15% to 35% greater than the length of the radial flange and top flange.

Alternatively, the ring seal may comprise a plurality of annular flanges encircling the ring seal and extending outward from an inner wall of the seal ring a distance sufficient to contact the container during use. The flanges include first, second, third and fourth flanges with the first flange at the bottom of the ring seal and the second flange above the first flange and the third flange above the second flange and the fourth flange at the top of the ring seal. The first and second flanges advantageously extend upward at an angle of 8° to 12° to the vertical and have a length of 0.1 to 0.2 inches along their upwardly extending length. The third flange advantageously extends radially, and the fourth flange extends upward at an angle of 20° to 30° to the vertical. Moreover, the third and fourth flanges advantageously extend outward from the inner wall of the seal ring a radial distance that is 5% to 30% less than the corresponding radial distance of the first and second flanges.

The above variations of the cap may be used to form an apparatus including the container with the sealing ring of the cap inserted into and forming a seal with the container opening. The container may a container sidewall that is inclined outward at an angle of less than 5° relative to the vertical so the cross-section of the container in a plane orthogonal to the longitudinal axis increases toward the bottom of the container. Preferably, the cross-section increases along a majority of the axial length of the container.

BRIEF DESCRIPTION OF THE DRAWINGS

These and other advantages and features of the invention will be better appreciated in view of the following drawings and descriptions in which like numbers refer to like parts throughout, and in which.

DETAILED DESCRIPTION

Figure 1:
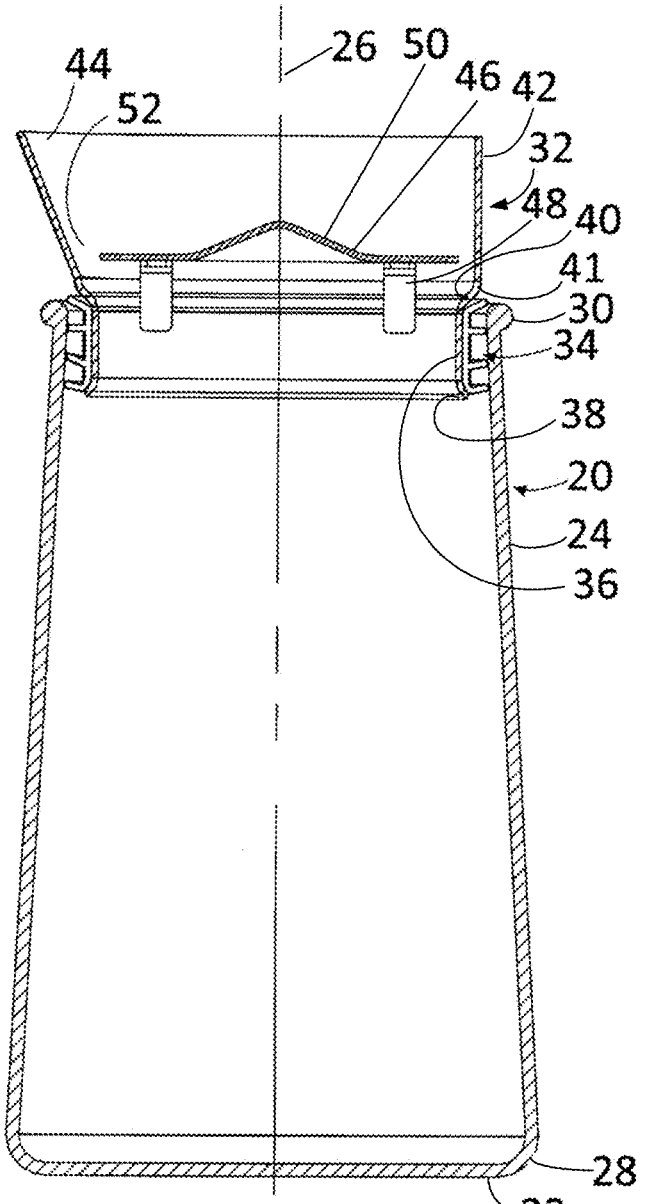
FIG. 1 is a cross-sectional view of an empty container and closure or cap, taken along a longitudinal axis of the container.

As used herein, the relative directions above and below, top and bottom, upstream and downstream are with respect to the vertical direction when the container shown in FIGS. 1 and 2 rests on a horizontal surface. Thus, the opening in the top of the container is above the closed bottom of the container and that opening is upstream of the container's bottom as fluid flows downstream from the top to the bottom. The relative directions inner and outer, inward and outward are with respect to the longitudinal axis of the container. Thus, the container's sidewall is outward of the container's longitudinal axis. As used herein, an "axial distance" refers to a distance measured parallel to the longitudinal axis. As used herein, "extending along the axis" includes extending parallel to the longitudinal axis. As used herein, a majority refers to over 50%, a substantial majority refers to over 80% and substantially all refers to 95% or more. As used herein, "fluid" includes gases dissolved in or carried in liquid, but does not include gases alone or any mixture or solution of liquid and gases with less than 50% liquid and the remainder being gases, and preferably does not include any mixture or solution of liquid and gases with less than 70% liquid (with the remainder being gases), and more preferably does not include any mixture or solution of liquid and gasses with less than 90% liquid and 10% gases.

As used herein, the following numbers refer to the following parts: 20—container; 22—container bottom; 24—container sidewall; 26—longitudinal axis; 28—bottom corner; 30—container lip; 32—cap; 34—ring seal; 36—bottom, ring portion of cap; 38—bottom lip; 40—first shoulder on cap; 41—second shoulder on cap; 42—cap splashguard; 44—spout; 46—dispersing disk; 48—support; 50—shaped protrusion; 52—outward facing side of disk; 60—inner wall of seal; 62—first bottom flange; 64—second from bottom flange; 66—third from bottom flange; 68—fourth from bottom flange—top flange; 80—stream; and 82—fluid.

Referring to FIGS. 1-4, a container 20 has a bottom 22 and has a sidewall 24 extending along and encircling a longitudinal axis 26 of the container. The bottom 22 advantageously has a continuous rounded corner 28 joining the bottom end of the sidewall 24. A lip 30 encircles the top opening of the container. The rounded lip advantageously extends outward and has a generally circular cross-section. A cap 32 fits into the opening in the top of the container 20, with a fluid seal 34 having an annular or ring shape is interposed between the cap and the container to provide a fluid tight seal between the cap and container, even when the sidewall 24 of the container is inclined at the location of the seal 34.

Referring to FIGS. 1-10 and 15-16, the closure or cap 32 has a bottom, ring portion 36 that advantageously forms an annular recess on an outward facing side of the ring portion 36 that is configured to receive an inward facing portion of the ring seal 34. The inward facing side of the ring portion forms a flow surface across which fluid flows during use, as described later. A bottom lip 38 extends from the bottom end of the cap 32 and the bottom, ring portion 36. The lip 38 preferably extends downward and outward from the bottom, ring portion 36 to help restrain the ring seal from axial movement downward along the axis 26 during use. A first shoulder 40 extends from the top end of the bottom, ring portion 36, preferably extending outward a distance from the ring portion 36 sufficient to restrain the ring seal 34 from axial movement upward along axis 26 during use. Thus, the lip 38 and the first shoulder 40 each extend outward from opposing top and bottom sides of ring portion 36 of the cap to form an annular recess to receive and hold the ring seal 34 and restrain movement along axis 26 during use.

The cap 32 advantageously (but optionally as discussed later) has a second shoulder 41 on the upper end of the first shoulder 40 and curving upward and forming a bottom of a cap splashguard 42 that advantageously extends upward from the second shoulder 41 and encircles the longitudinal axis 26 to form a generally cylindrical sidewall. The shoulders 40, 41 form a transition between the splashguard 42 which has a larger diameter, generally circular cross-section in the plane orthogonal to the longitudinal axis 26, and the ring portion 36 which has a smaller transition. The transition is a short conical section, and rather than having sharp corner at the junctures of the cone with the cylindrical section, the juncture is rounded by shoulders 40, 41. The conical section could become relatively flat and approach a radial surface, in which case the shoulders 40, 41 could form an annular ledge, but that is not preferred but may be usable if the radial portion is sufficiently short to allow the fluid to maintain an annular flow across the juncture.

Figure 5A:
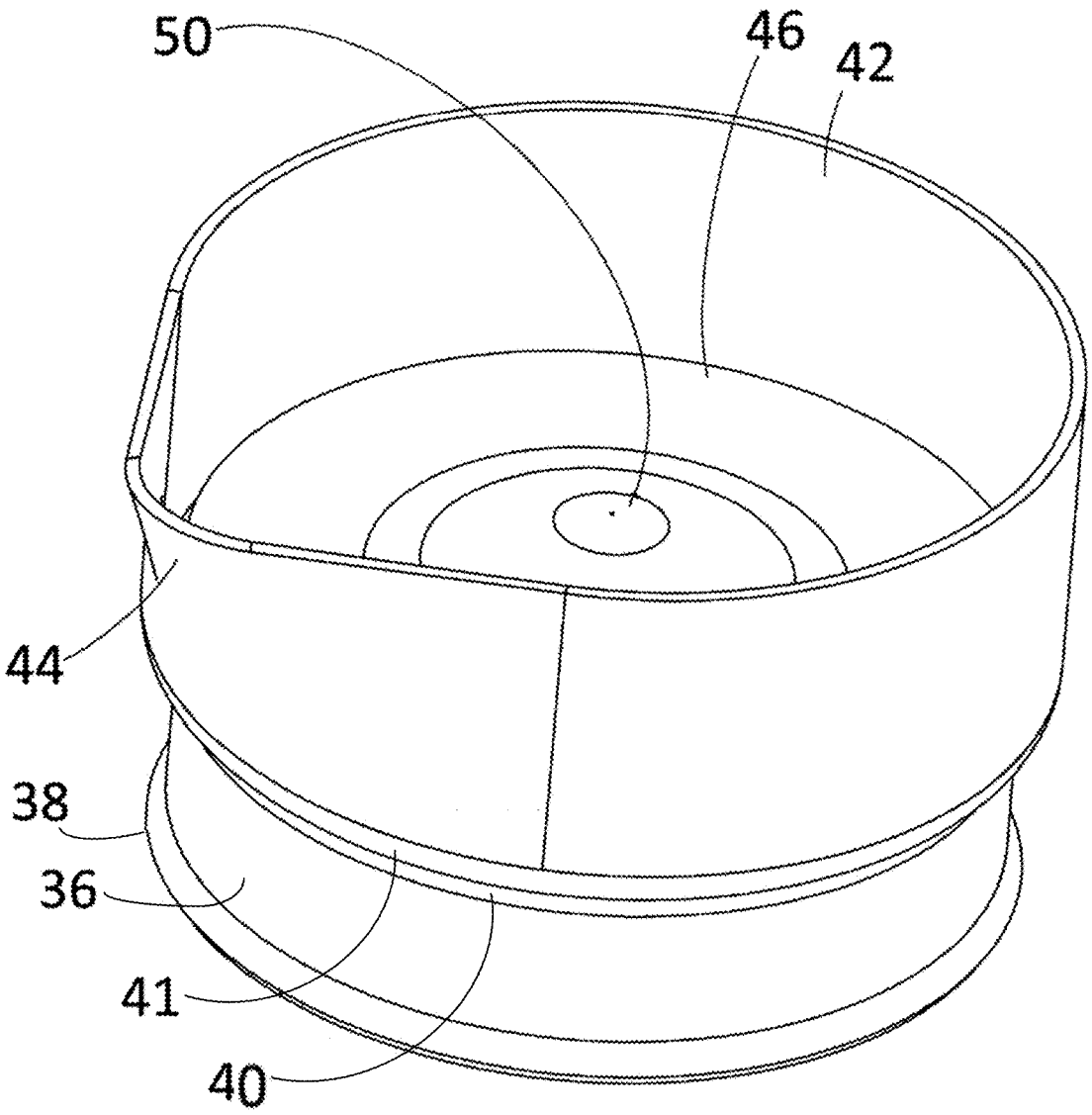
FIG. 5A is a top perspective view of the cap of FIG. 1.
Figure 5B:
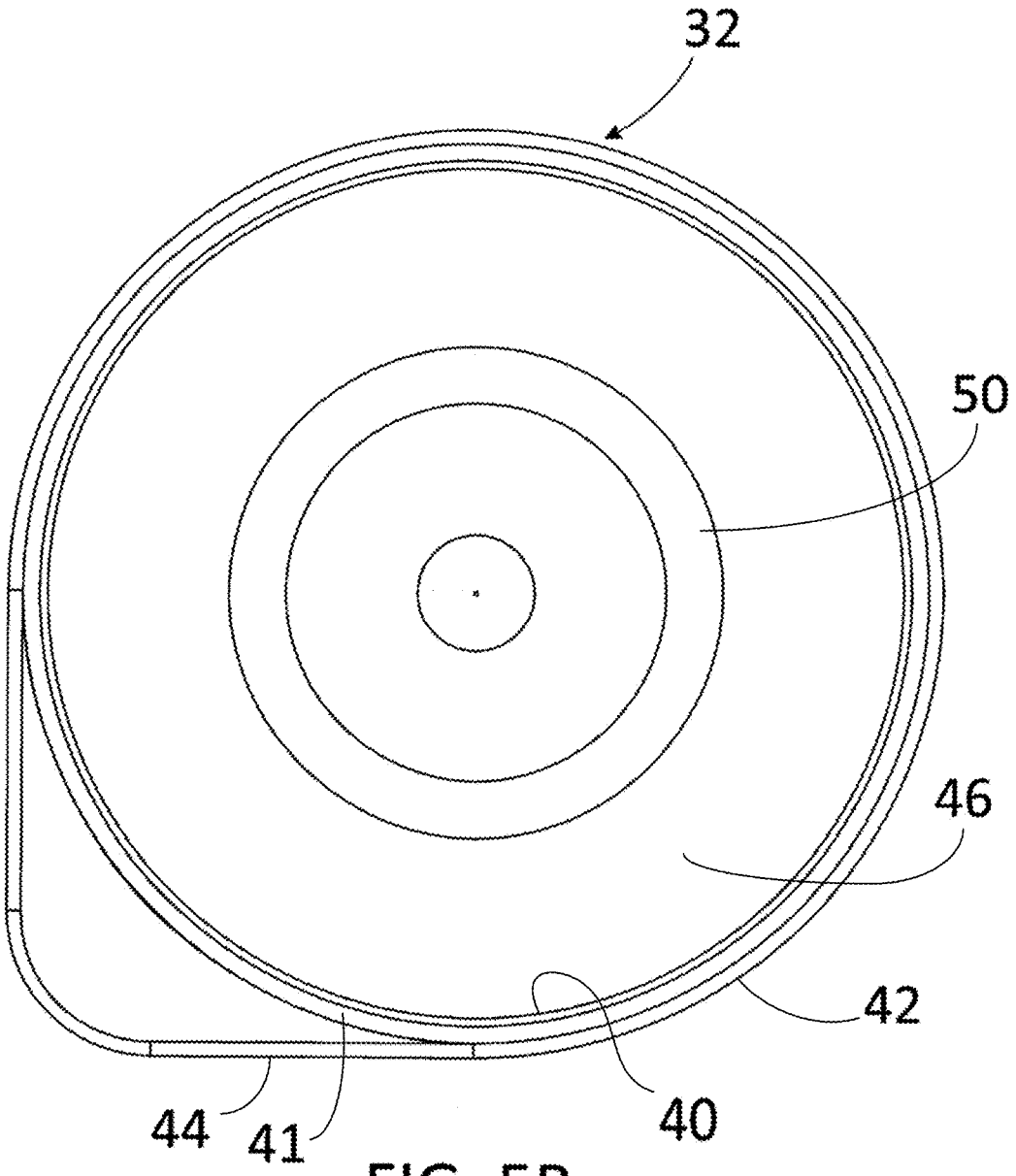
FIG. 5B is a top view of the cap of FIG. 1.
Figure 5C:
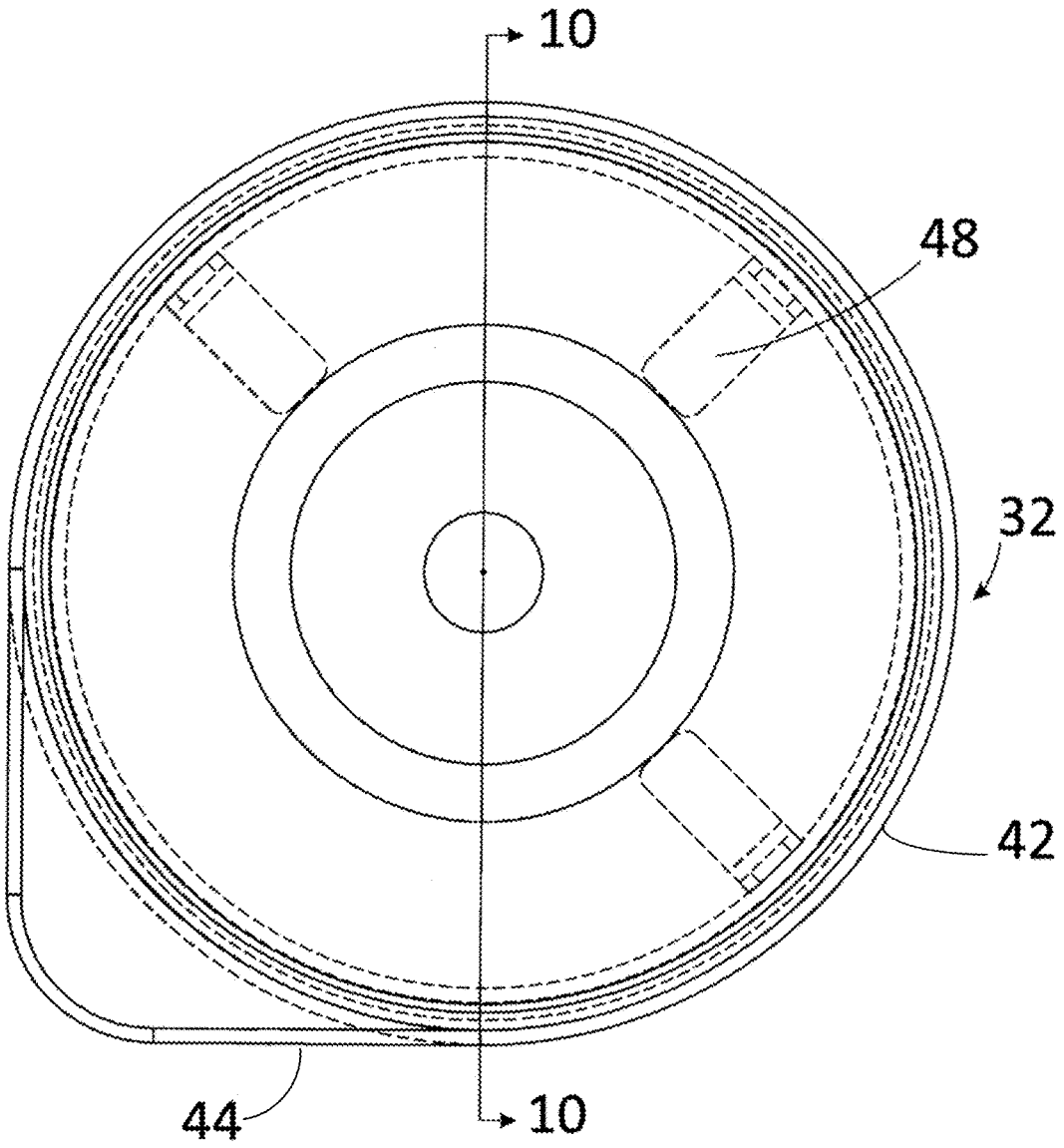
FIG. 5C is a top view of the cap of FIG. 5B with several internal components shown in dashed lines.
Figure 5D:
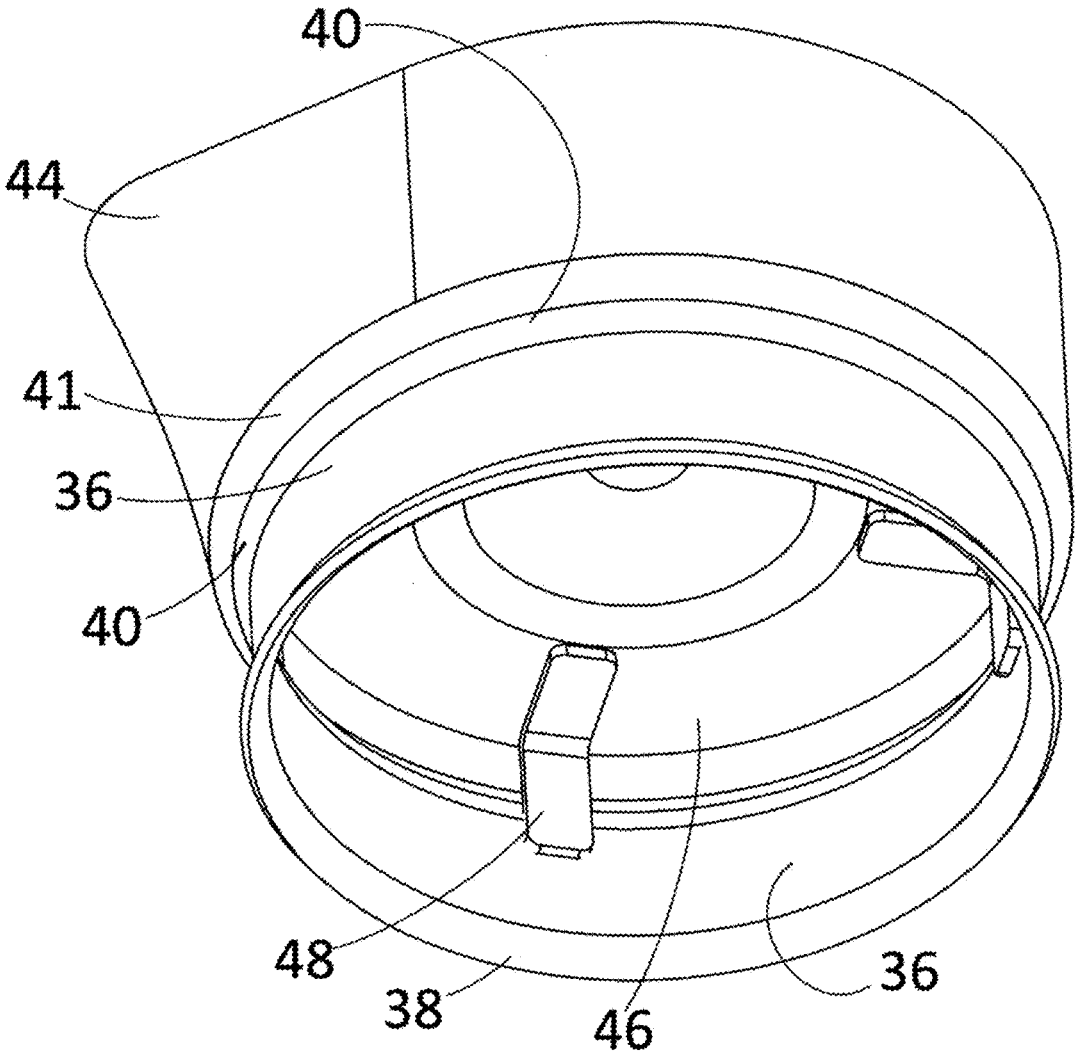
FIG. 5D is a bottom perspective view of the cap of FIG. 5A.
Figure 6:
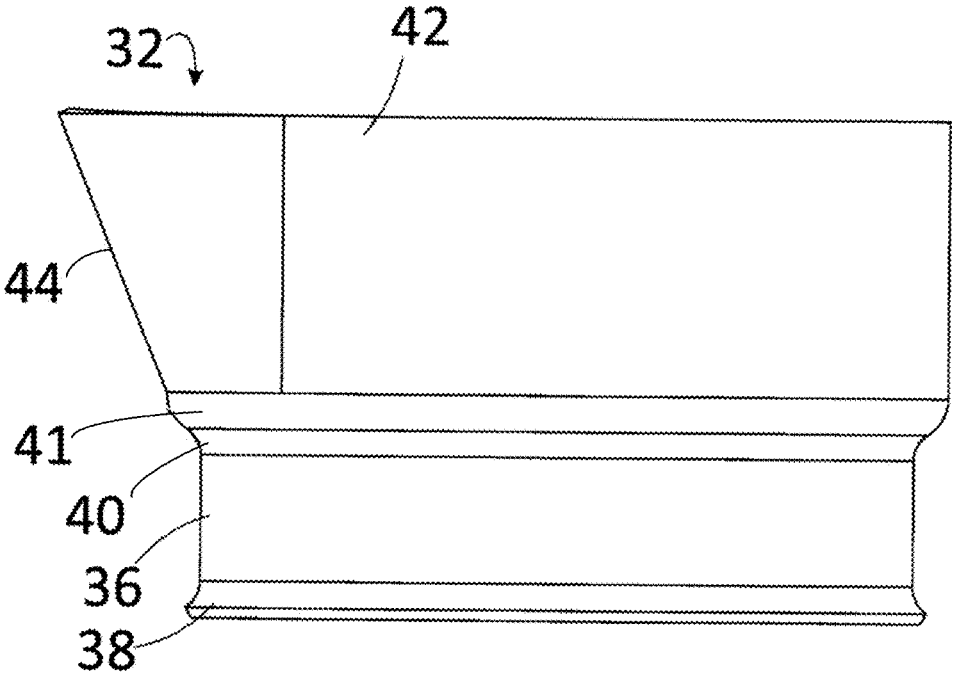
FIG. 6 is a side view of the cap of FIG. 5A.
Figure 7:
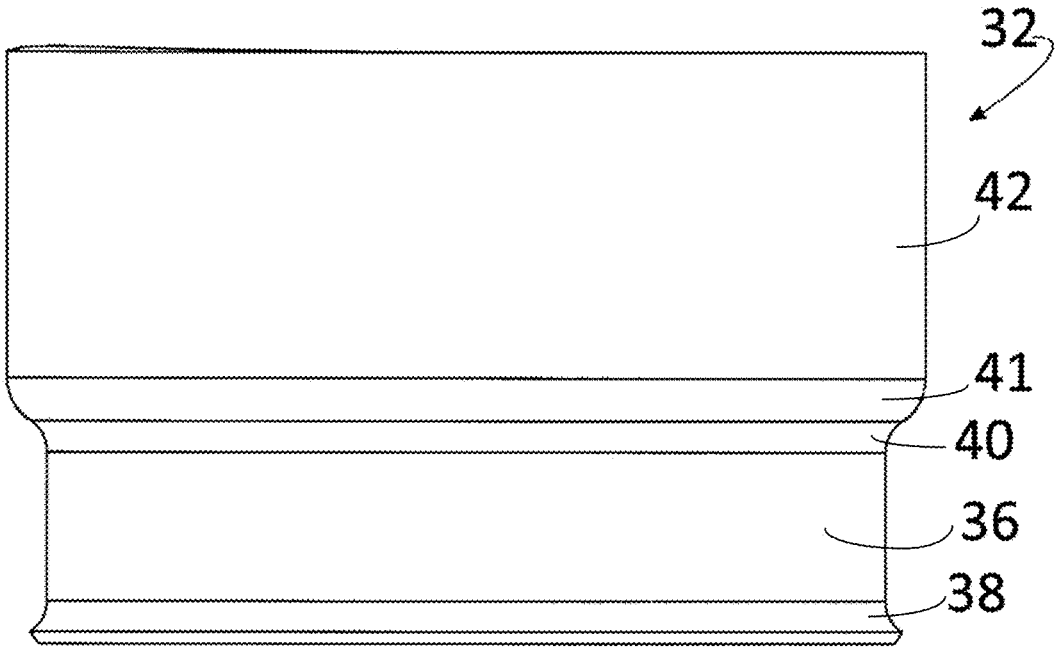
FIG. 7 is a back view of the cap of FIG. 5A, opposite the spout.
Figure 8:
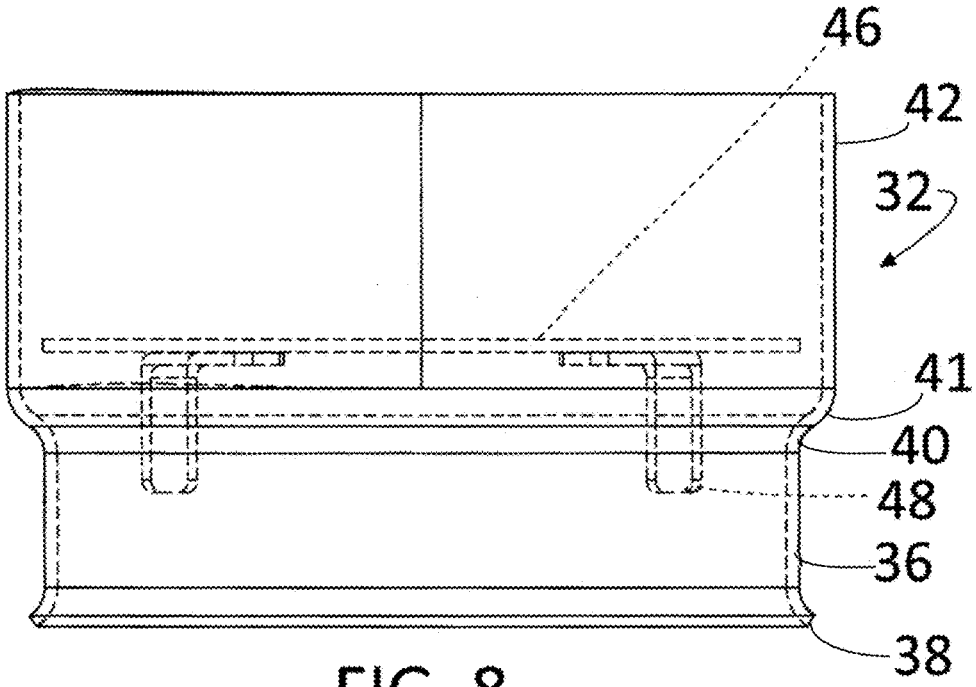
FIG. 8 is the back view of FIG. 7 with internal components shown in dashed lines.
Figure 9:
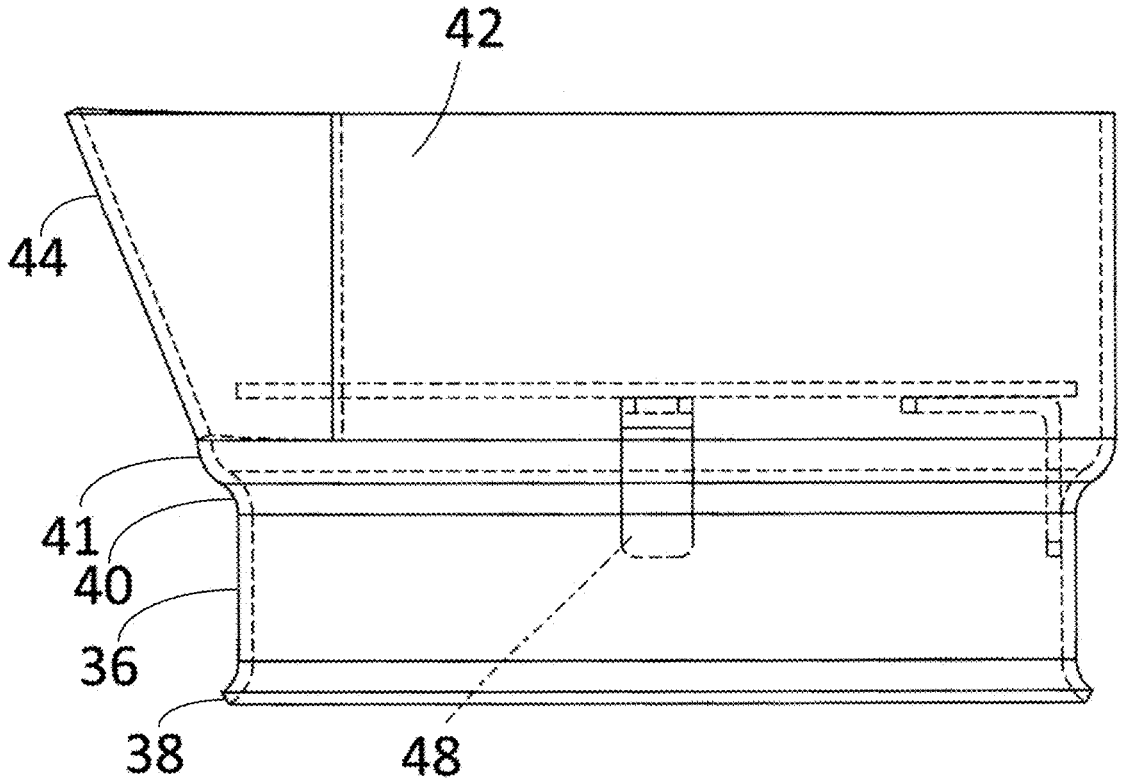
FIG. 9 is the side view of FIG. 6, with internal parts shown in broken lines.

The splashguard 42 may include a pouring spout 44 and advantageously, one portion of the sidewall is inclined outward to form a pouring spout 44. The spout 44 is shown as having a generally V-shaped cross-section in the horizontal plane orthogonal to axis 26, with the legs of the V being longer toward the top of the cap and smaller toward the shoulders 40, 41 and ending at the second shoulder 41 in a smoothly contoured juncture with that second shoulder. The spout 44 is advantageously formed as part of the splashguard 42. As shown in FIGS. 5B-5C, the top portion of the spout 44 may be formed by tangents to the circular periphery of the splashguard 42 when the splashguard has a circular cross-section, with the spout decreasing in size in the downward direction until the bottom of the spout merges with the circular sidewall of the splashguard at or preferably just above the second shoulder 41.

Advantageously, the cap splashguard 42 and bottom, ring portion 36 are coaxial and, except for the spout 44, and may form two coaxial cylinders of differing diameter centered on the axis 26 as shown in the depicted embodiment. The juncture of the cap splashguard 42 and the second shoulder 41 is advantageously a curved surface that curves inward and downward. The connection of the shoulders 40, 41 may advantageously take the form of two coaxial cylinders of slightly different diameter with a conical section extending between the two adjacent ends of the cylinders. Thus, the junctures of the shoulders 40, 41 may along a conical surface inclined inward and downward as seen in FIGS. 1-2. If the cap and container are not circular in cross-section but a multi-sided one with rounded corners between flat sides then an inclined surface may still join the flat portions of the two coaxial shapes, with a conical surface at rounded corners.

Note that when viewed from the perspective of the ring portion 36 looking up along axis 24, the first shoulder 40 curves outward but when viewed from the perspective of the splashguard 42 or the second shoulder 41 looking downward, then the first shoulder 40 curves inward and downward. It is perhaps more accurate to describe the lip 38 and first shoulder 40 has having a constant radius of curvature that is located on the outside of the cap, while the second shoulder has a constant radius of curvature inside the cap.

Referring to FIGS. 1, 2, 10 and 15-16, a dispersing disk 46 is connected to the cap 32 by one or more supports 48. The disk 46 is a continuous disk in that it has no holes through it and presents continuous surface facing upward. The supports 48 are shown as L-shaped members having a vertical leg connected to the vertical sidewall formed by the bottom, ring portion 36 of the cap and a horizontal leg connected to the dispersing disk 46, preferably the bottom of the dispersing disk. The connection of the cap and dispersing disk can take other forms, including radially extending struts connected to the splashguard 42, or members extending from the splashguard downward to the dispersing disk.

Figure 10:
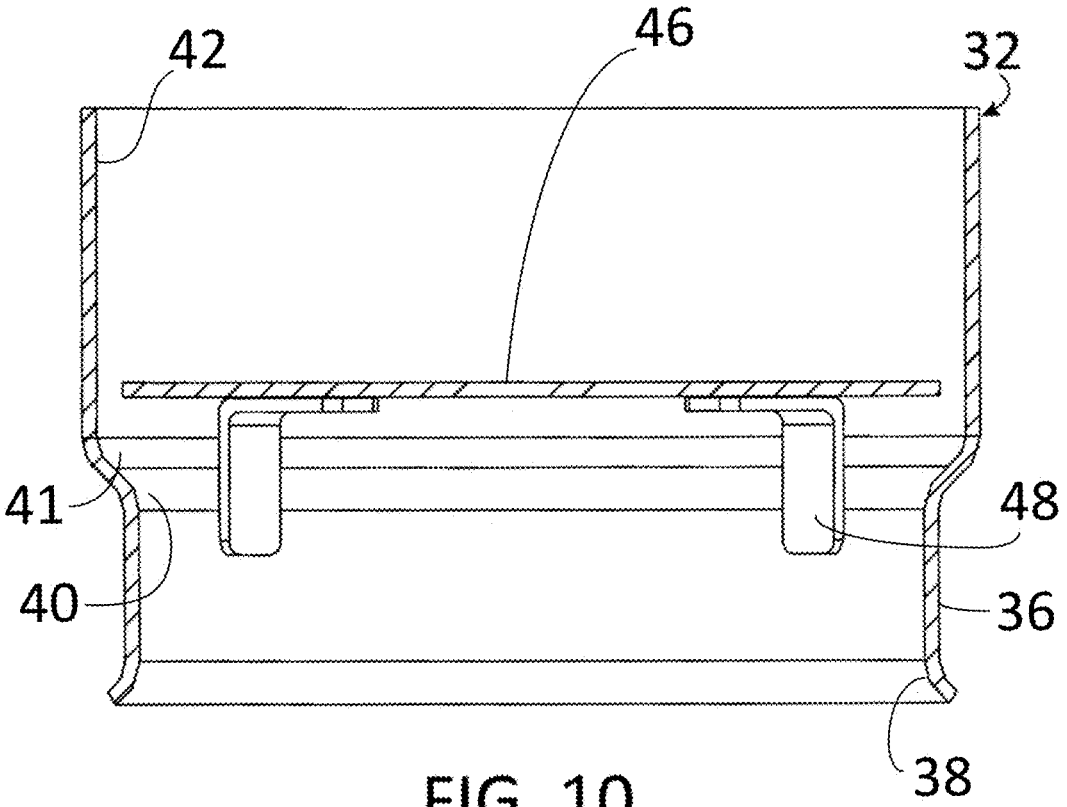
FIG. 10 is a sectional view of a cap taken along section 10-10 of FIG. 5C, but with an alternative dispersing disk.
Figure 11:
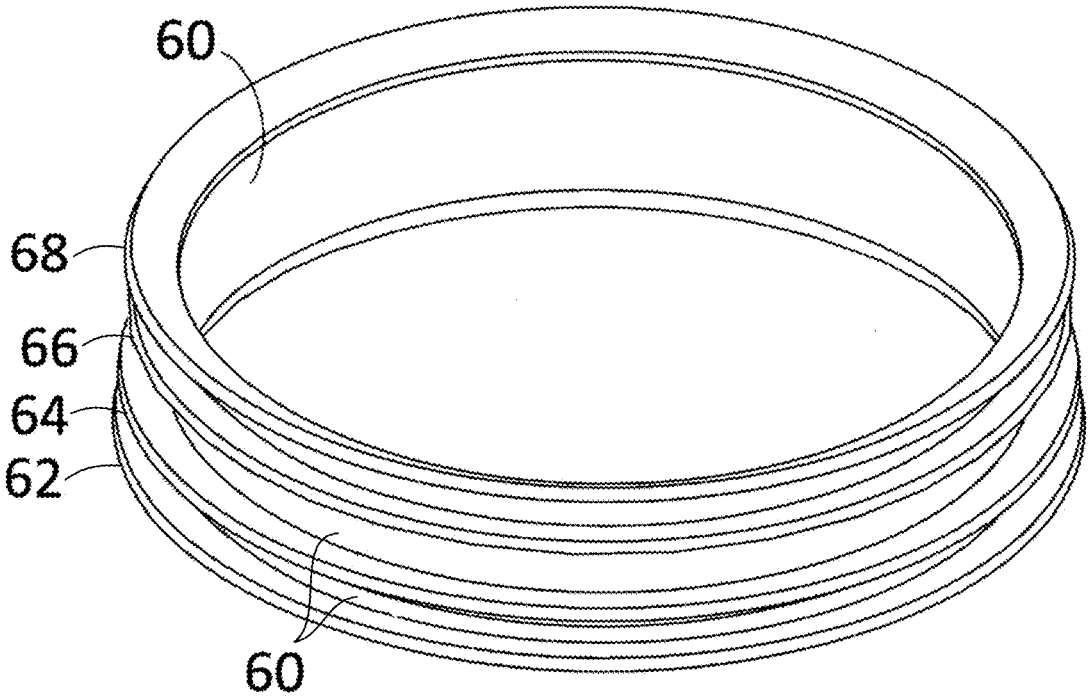
FIG. 11 is a top perspective view of the seal of FIGS. 3 and 4.
Figure 12:
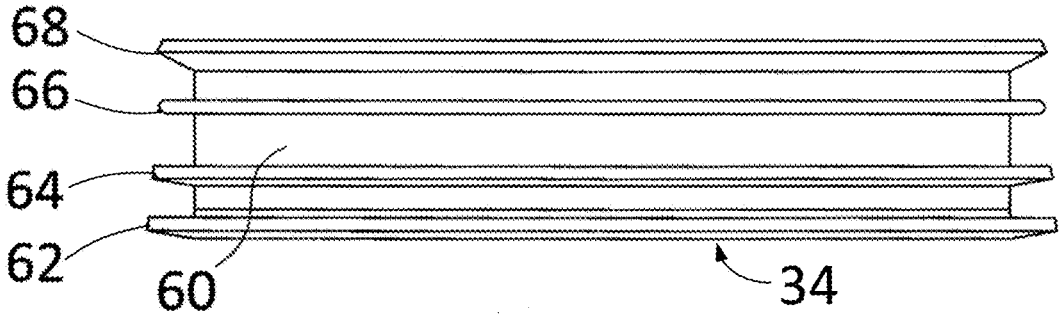
FIG. 12 is a side view of the seal of FIG. 11.
Figure 13:
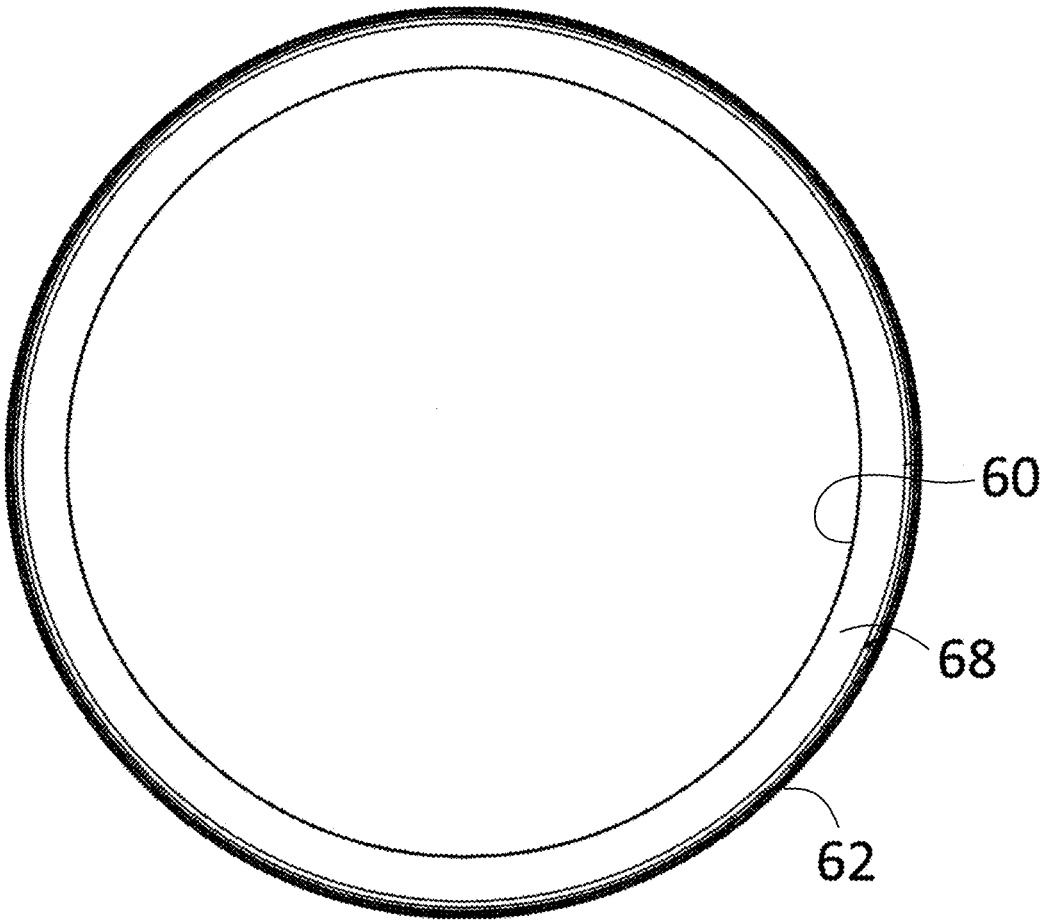
FIG. 13 is a top view of the seal of FIG. 11.

The dispersing disk may have a flat top surface or upward facing surface as shown in FIG. 10, or it may have a raised surface forming a shaped protrusion 50. The shaped protrusion 50 is preferably centered on the longitudinal axis 26 and is shown as a symmetrically curved or domed surface in FIGS. 1-2, with such surfaces generally categorized as a surface of revolution as such surfaces are symmetric in the multitude of planes that extend along the longitudinal axis.

The dispersing disk 46 has an outer edge that extends over the first shoulder 40 joining the cap's splashguard 42 to the bottom, ring portion 36. Thus, the outward facing side of the dispersing disk 46 extends outward beyond the inner cylindrical surface of the bottom, ring portion 36, but is located inward of the cap's splashguard 42. The dispersing disk 46 preferably has a circular periphery and mounted on supports 48 so it is orthogonal to the axis 26 and equally spaced radially and axially relative to the cylindrical surface of the bottom, ring portion 36 and the first shoulder 40.

Figure 2:
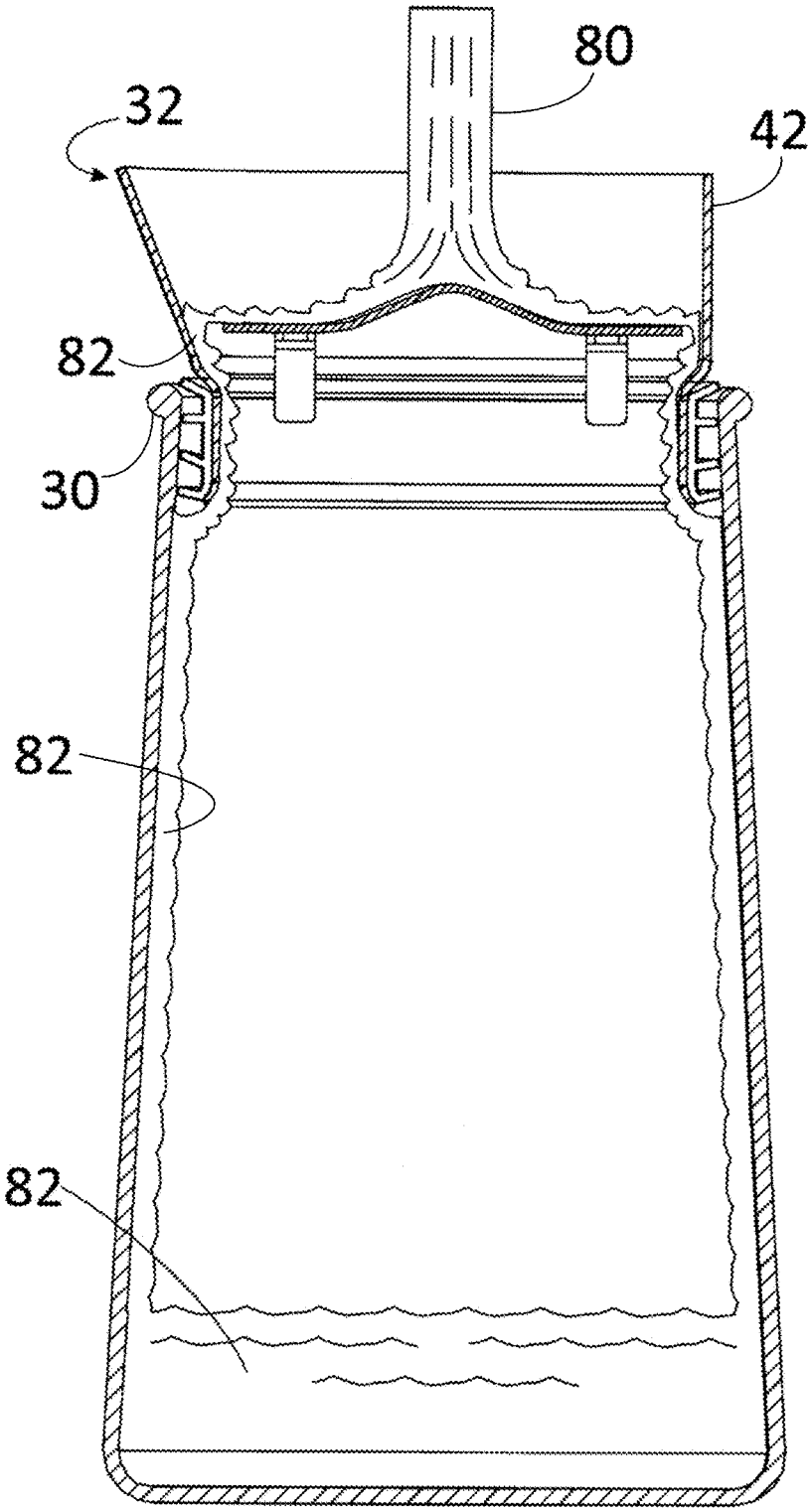
FIG. 2 is a cross-sectional view of the container and closure or cap of FIG. 1, showing a stream of liquid filling the container.
Figure 3:
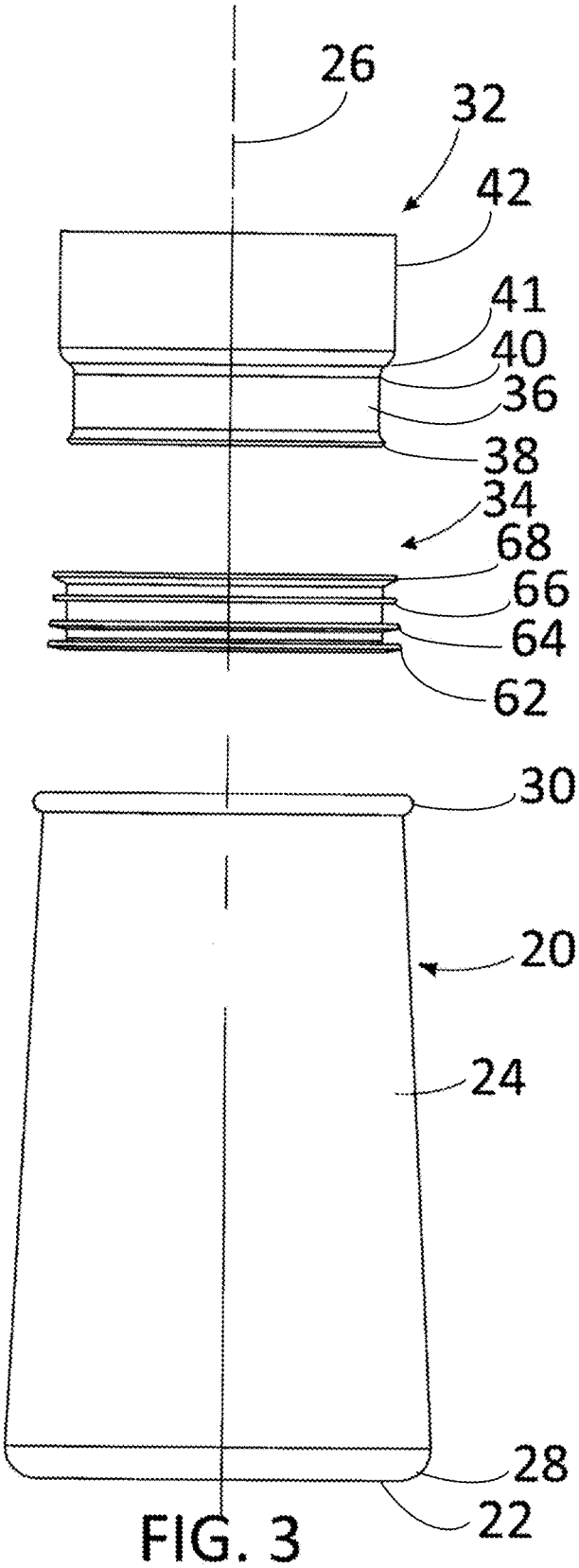
FIG. 3 is an exploded view of the container and closure or cap of FIG. 1 with a short length container.
Figure 4:
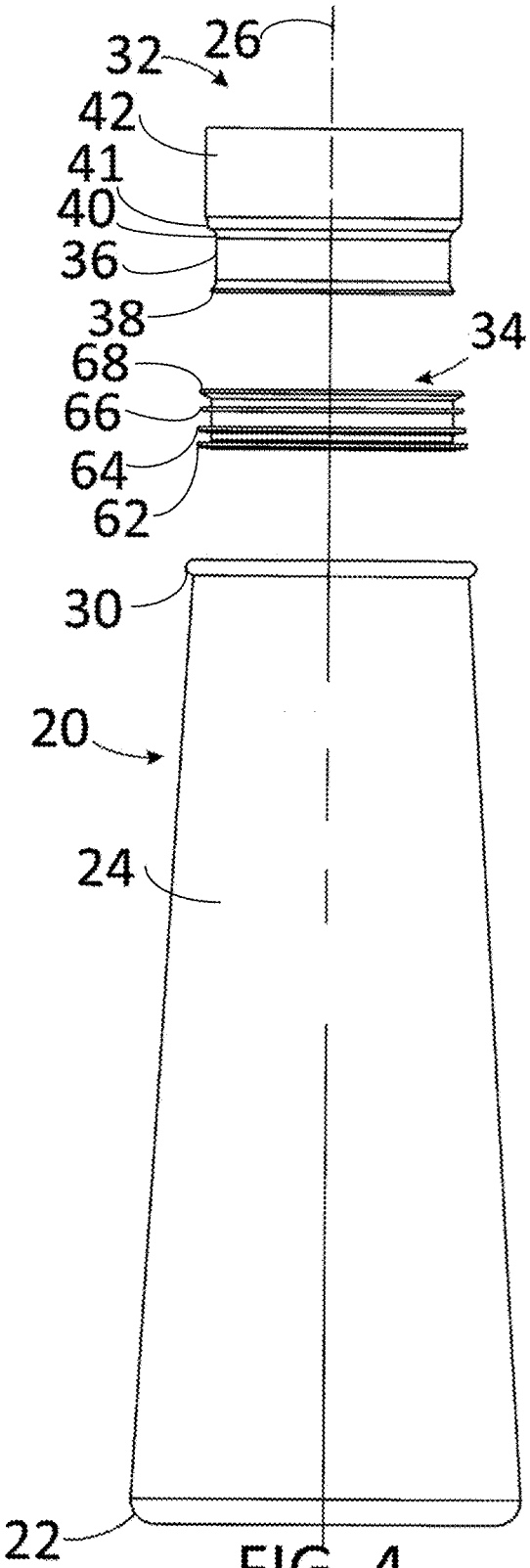
FIG. 4 is an exploded view of the container and closure or cap of FIG. 1 with a tall container of longer length.

Referring to FIGS. 1-4 and 11-14, the ring seal 34 has an annular shape and is interposed between the bottom of the cap 32 and the top of the container 20. Advantageously, the ring seal comprises a cylindrical inner wall 60 with four annular flanges 62, 64, 66, 68 extending outward from that inner wall 60, with all of the flanges and inner wall having substantially the same thickness and simultaneously molded and formed of the same material to form a single, unitary part. The first, second, third and fourth flanges, respectively part numbers 62, 64, 66, 68, all extend outward from the inner wall 60. The lowest two flanges, first and second flanges 62, 64 being inclined upward at an angle of about 30° to 45° relative to the inner wall 60 and the axis 26. The first, bottom flange 62 extending slightly further outward than does the second flange 64. The third flange 66 extends radially outward from the inner wall 60 and does not extend outward as far as either the first or second flange. The third flange 66 has a rounded peripheral edge, while the first, second and fourth flanges 62, 64, 68 advantageously have square edges around the outer periphery of those flanges. The top flange or fourth flange 68 is inclined upward relative to the inner wall 60 and axis 26, and advantageously extends outward from axis 26 further than the third flange, and advantageously extends outward a distance that its outer periphery rests against the top of the container 20 at the top lip 30 as seen in FIGS. 1-2.

Figure 14:
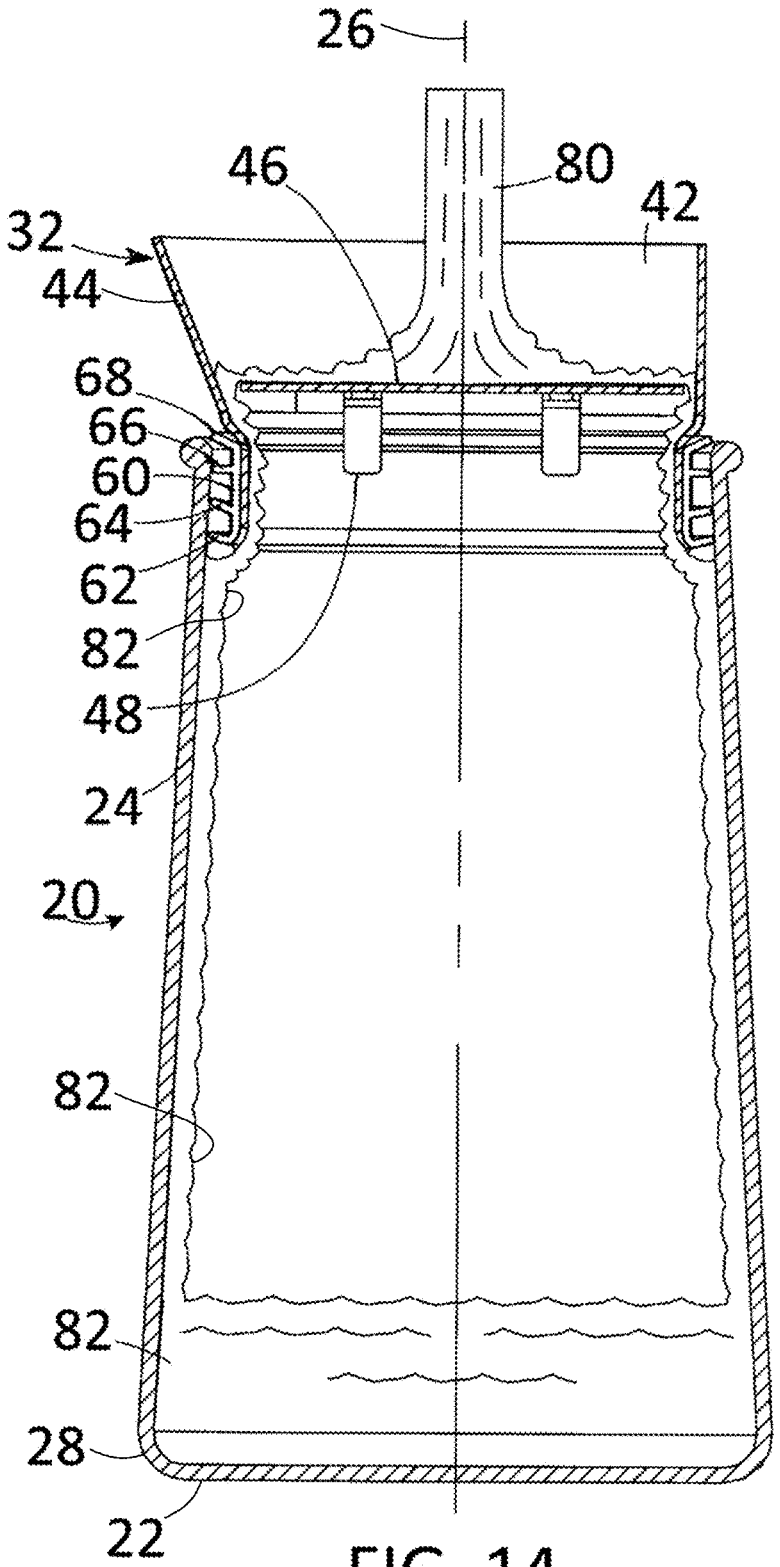
FIG. 14 is a cross-sectional view of an alternate embodiment of a cap, on the container of FIG. 2.
Figure 15:
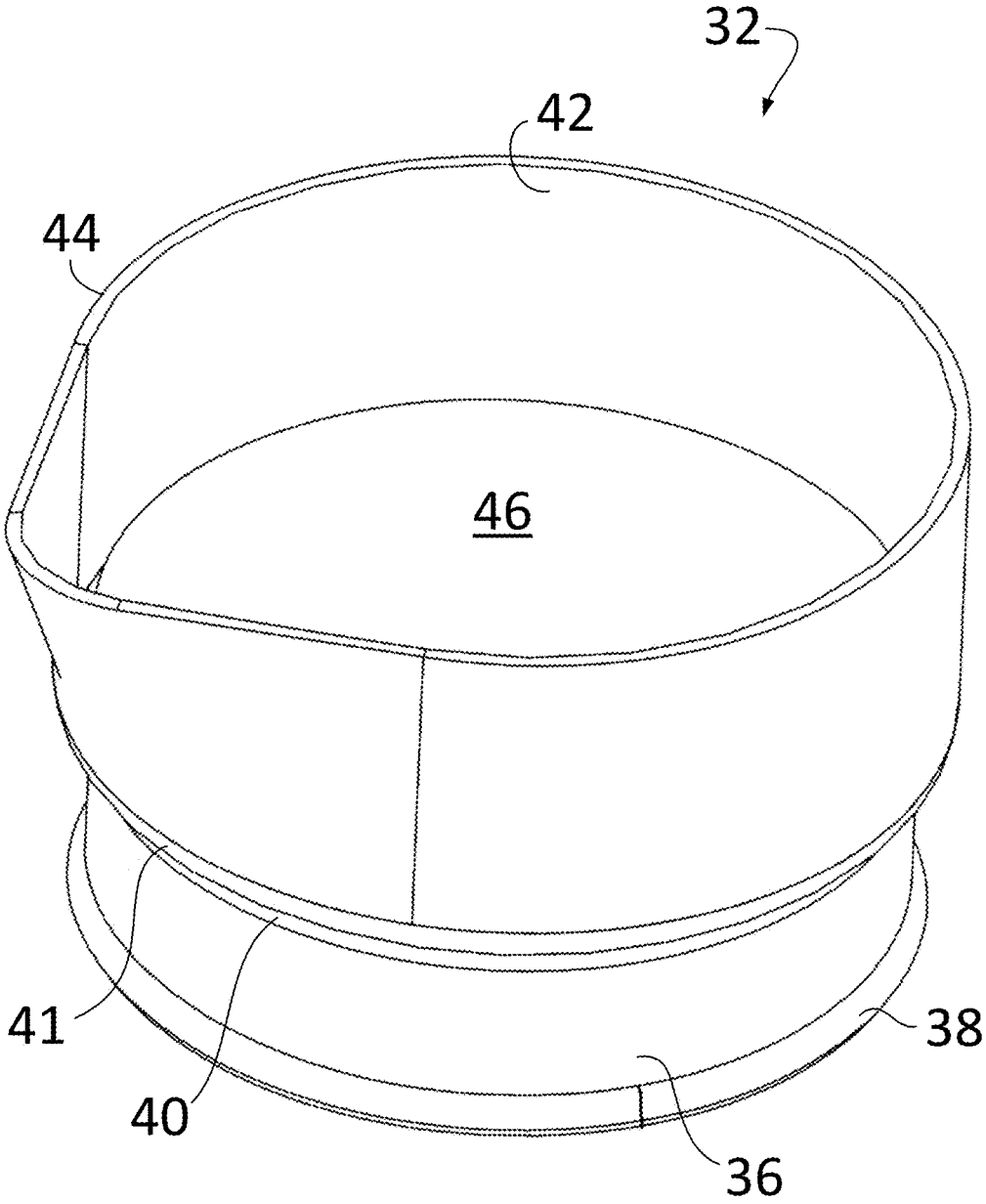
FIG. 15 is a perspective view of the cap of FIGS. 8-10 which has a flat dispersion disk.
Figure 16:
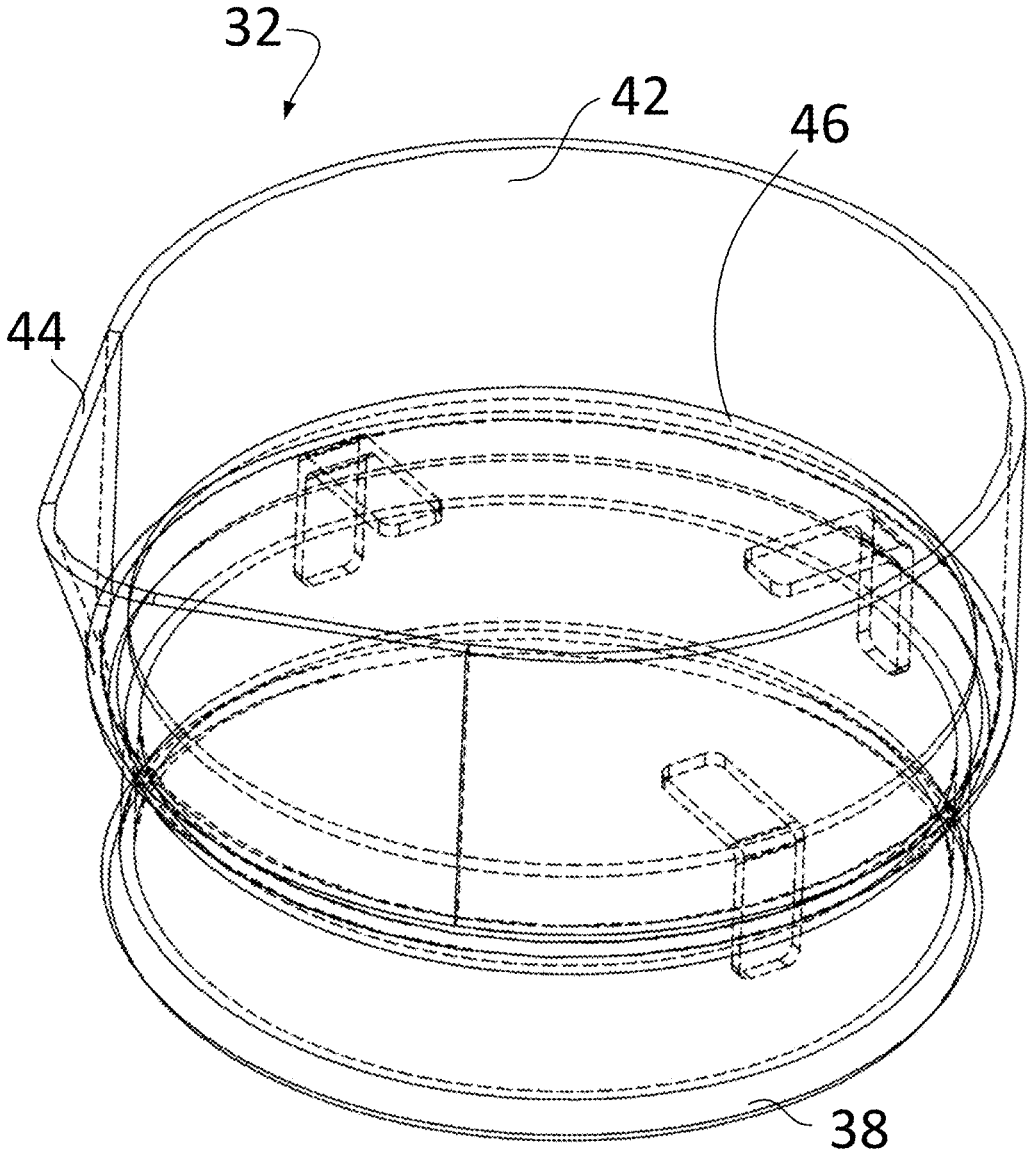
FIG. 16 is the perspective view of FIG. 15 but with internal components shown in dashed lines.

The first, second and third flanges 62, 64, 66 are shown in FIGS. 1-2 and 14 as just touching the inside surface of the container's sidewall 24. But those flanges and inner wall 60 are advantageously sized so that during use, the bottom flange, first flange 62 bends upward against the second flange 64 to wedge the ring seal against the sidewall 24, with the third flange 66 providing a redundant seal, and with the fourth flange 68 contacting the rim 30 of the container 20, preferably along an inward and upward facing portion of that rim 30. The bottom or first flange 62 is inclined upwards which helps insertion of the sealing ring 34 and cap 32 into the opening in the top of the container 20. The upwardly inclined flanges 62, 64 and possibly 66 resist removal of the cap 32 which requires upward motion of the cap and engaged flanges along axis 26. The inclined bottom flanges 62, 64 are inclined upward to help insert the ring seal 34 into the opening of the container 20 and that upward inclination makes it more difficult to remove the seal 34 and cap 32. The bottom two flanges 62, 64 also bend the most during insertion and expel the air from the annular space between the first and second flanges 62, 64 to create a slight vacuum that helps the cap 32 to stay in the container's opening when the container is inverted during use and the weight of the liquid in the container tries to push the cap out of the container opening.

Depending on the taper of the inclined wall 24, the radial distance by which the first and second flanges 62, 64 extend outward, and the differences in length of those flanges, will vary. For the depicted embodiment of ring seal 34 for use with a container 20 having a top opening diameter of 65 mm, the flanges 62, 64, 66 and 68 have an outer diameter of 65-66 mm and extend radially about 3-4 mm from the inner wall 60. The flanges 62, 64, 66, 68 have an axial thickness of 1-2 mm, and the seal ring has an axial height of 15 mm. The axial length of the lower, ring portion 36 of the cap is advantageously the same as or one or two mm less than the axial height of the ring seal 34 measured at the middle of the curvature of those shoulders, so the ring portion 36 causes at least the bottom, first flange 62 to be urged upward.

Referring to FIGS. 1 and 2, during use, the cap 32 is connected to the container 20 by pushing the sealing ring 34 into the opening in the top of the container, here the opening defined by and encircled by rim 30. This places the dispersing disk 46 so that it blocks the stream 80 of fluid 82 into the container. The cap 32 thus acts as a closure for the container 20 as it inhibits direct flow of fluid into the inside of the container. Fluid can still enter the container 20, but it must flow between the dispensing disk and the splashguard 42 and spout 44 of the cap 32 to do so.

The user may set the bottom 22 of the container on a dispersing surface of a drink dispenser or table etc., and turn on a spigot to dispense carbonated fluid into the top of the cap 32 enclosed by the splashguard 42 and spout 44, or simply pour a carbonated fluid from a container into the top of the cap. The resulting poured or dispensed stream 80 of carbonated fluid 82 is preferably directed to the center of the shaped protrusion 50 on the dispersing disk 46. The shaped protrusion 50 directs different parts of the impacting stream 80 outward along the surface of the dispersing disk 46 to reduce splatter and splashing. The splashguard 42 (which includes the spout 44) catches any splashed fluid 82 where gravity carries it along the inner wall and into the container 20. The fluid 82 flows outward and over the outer periphery of the dispersing disk 46 between the cap's wall 42 and the outer side 52 of the disk. The fluid 82 falls down as it passes over the outer periphery of the dispersing disk 46 and contacts the vertical portion of the cap's splashguard 42 around a majority of the cap's splashguard and preferably around a substantial portion of that periphery. The fluid 82 flows inward and downward at the location of the second shoulder 41, which is configured to achieve that change in direction while avoiding turbulence and splashing. It is believed that the change of direction achieved by the second shoulder helps reduce the velocity of the fluid flow and maintain laminar flow. The fluid 82 flows from the second shoulder 41 downward over the first shoulder 40 and along the vertical portion of ring 36 and then flows outward and downward along the bottom lip 38 of the cap. The bottom lip 38 directs the flow of fluid 82 downward and outward against the inner side of the sidewall 24. The sidewall 24 is advantageously inclined in a downward and outward direction at an angle selected so the fluid 82 flows along the sidewall rather than drop vertically and splash against the bottom 22 or the pool of fluid collecting in the bottom portion of the container 20. The corner 28 of the bottom of the container 20 is curved so the fluid 82 flowing down the sidewall 24 does not splash against the bottom 22 and instead flows smoothly, with no splashing or substantially no splashing and with a substantially laminar flow. Advantageously that above described laminar flow, including the substantially laminar flow, is achieved for that flow occurring downward of the first shoulder 40 and preferably downward of the dispersing disk 46.

Advantageously, whether the fluid is carbonated water with no sugar, or diet carbonated sodas with less than one calorie, or carbonated and sugared sodas, or beer, the outer periphery of the dispersing disk is close enough to the splashguard such that a majority of the fluid flowing outward from the dispersing disk at a flow rate of at least 1 gpm will hit the inside of the splashguard and flow downward, with a major portion of the flow along the inward facing surface of the cap below the dispersing disk being a laminar flow, an advantageously with a substantial portion of the flow along the inward facing surface of the cap below the dispersing disk being a laminar flow, and preferably with substantial all of the flow along the inward facing surface of the cap below the dispersing disk being a laminar flow.

The bottom lip 38 directs the fluid 82 outward and downward onto the inward facing surface of the sidewall 24 of the container 20. Advantageously, a major portion of the flow across the bottom lip 38 and down the inside of the container sidewall along the inward facing surface of the cap is a laminar flow, and preferably a substantial majority of the flow across the bottom lip 38 and down the inside of the container sidewall along the inward facing surface of the cap is a laminar flow, and preferably a substantial portion of the flow across the bottom lip 38 and down the inside of the container sidewall along the inward facing surface of the cap is a laminar.

When fluid 82 is poured out of the container 20, the loss of carbonation is also reduced as the flow of fluid is in the opposing direction and the distributing disk 46 slows fluid flow through the annular, radial space between the distributing disk 46 and the splashguard and out the spout 44.

Because the amount of splashing depends on the fluid stream 80 and how it hits the dispersing disk, the specified flows herein assume the stream 80 hits the dispersing disk 46 in a way that maximizes the uniform distribution of the fluid around the periphery of the dispersing disk and maximizes the laminar flow along the flow path from that dispersing disk to at least the beginning portion of the container sidewall.

The contours of the inward sides of the cap's shoulders 40, 41 and the bottom ring portion 36 with its lip 38, are configured to cause the fluid 82 to flow along those inner sides of the cap and onto and along the inner side of the container's sidewall 24 and preferably to flow with substantially no splashing or turbulence, and ideally to achieve a laminar flow or substantially laminar flow along the flow path traversing those parts. The sidewall 24 is inclined at an angle to achieve downward flow with a substantial majority of the flow laminar and preferably with substantially all of the fluid 82 flowing along the sidewall in a laminar flow rather than separating into drops that splash into the pool forming on the bottom of the container 20. Note that the shoulder 41 is above the shoulder 40 along the length of axis 26, and thus the shoulder 41 may be referred to as the top shoulder 41 or the upper shoulder 41 or upstream shoulder 41, while the shoulder 40 may be referred to as the lower shoulder 40 or bottom shoulder 40 or lower shoulder 40. The other parts of the cap 32 may be similarly referred to relative to their relative position along axis 26 or their relative position along the direction of flow as the container is filled with fluid 82.

The spacing between the dispersion disk 46 and the cap's splashguard 42 and first shoulder 40 are selected to reduce turbulence and splashing and are selected primarily to cause the fluid 82 to flow into contact with the splashguard so as to flow down the splashguard wall in a laminar flow, effectively held to the flow path through the cap and along the container's sidewall by surface tension and capillary action. The spacing is based in part on the density of the fluid 82, the viscosity of the fluid and the velocity and direction with which the fluid exits the periphery of the dispersing disk and how far it drops before hitting the splashguard 42. The spacing may also be based on the height of the top surface of the outer periphery of the dispersing disk above the shoulder 40 when that shoulder is located inward of the outer periphery, so the outer periphery extends a distance radially beyond the shoulder 40. In some cases, the fluid 82 may hit the shield guard at or 1-2 mm below the level of the top surface of the dispersing disk (at the periphery of that disk as it may have a shaped protrusion 50), while in other cases the fluid may hit one of the inclined portions of either or both shoulders 40, 41.

A radial spacing of 2 to 5 mm is believed suitable for water and carbonated water, with a spacing of 4 mm preferred, between the outer periphery of the dispersion disk and the adjacent splashguard 42 in the lateral or radial direction from that outer periphery. A larger spacing is believed suitable for carbonated soft drinks sweetened with sugar and flavored with syrup. For beverages with higher viscosity and sugar content the spacing will increase, and it is believed that a spacing of 2 mm to 7 mm may be suitable for very viscous, carbonated beverages. A vertical spacing along axis 26 of 4 to 10 mm between that outer periphery and the second shoulder 41 is believed suitable, with a vertical spacing of 6-8 mm believed more preferable. It is believed both radial and axial spacing are desirable, but the radial spacing between the periphery of the dispersing disk and the cap's splashguard 42 may be sufficient by itself.

The sidewall 24 may be vertical or inclined inward or outward from the vertical. But if the sidewall 24 is inclined inward then the bottom 22 becomes smaller than if the sidewall was vertical or inclined outward and a smaller bottom makes the container less stable. Thus, the sidewall 24 is advantageously vertical, or advantageously is inclined slightly outward and downward to form a larger base and provide a more stable container. This provides an increasing cross-sectional area in the plane orthogonal to the longitudinal axis 24, in the downward direction. A sidewall inclined outward and downward at an angle of up to about 5° from the vertical is believed suitable for carbonated water and soft drinks, with an inclined angle of about 3° being preferred. But a sidewall inclined inward at an angle of 60° or even approaching 90° is believed possible, just not very practical as the container volume is reduced.

It is believed that the bottom, ring portion 36 of the cap could be inclined inward toward axis 26, but that ultimately reduces the diameter of the bottom 22 and the stability of the container 20. The bottom, ring portion 36 could be inclined slightly outward and downward as is the container sidewall 24, but that makes it difficult to remove the wider seal bottom from the smaller diameter opening. Thus, a first shoulder 40 that is curved on an upper side to merge smoothly with the generally vertical cap splashguard 42 and guide the fluid 82 smoothly inward and downward into a vertical ring portion 36 is believed preferable.

A first shoulder 40 having an upward and inward facing curvature of 30 to 50 mm and advantageously about 40 mm, merging into a downward and outward curve with a curvature of 50 to 70 mm and advantageously about 60 mm, that blends into the (preferably) vertical bottom, ring portion 36 of the cap, are believed suitable for a diameter of about 60 mm (about 2⅜ inch). A short, downward and inward inclined conical portion a few mm long may extend between the inward facing and outward facing curves forming first shoulder 40 joining the splashguard 42 to the ring portion 36 of the cap. A cap splashguard 42 that is 25 mm (one inch) high is believed suitable to catch substantially all splashes arising from the stream 80 hitting the dispersing disk 46, and a protrusion 50 may allow a shorter sidewall height of 0.3 to 0.6 inches. The specific dimensions will vary with the particular design.

The above described cap and container are believed suitable for a flow rate of 1-3.5 gpm (gallons per minute) for a vertical stream 80, although the flow rant is preferably up to 1-2 gpm, and more preferably about up to 1-1.5 gpm.

For dispersing the fluid 82 from the container 20, the container is tipped or inclined so fluid flows through the gap between the dispersing disk 46 and the cap's splashguard 42 and out the outwardly extending spout 44. The ring seal 34 is advantageously designed so that it wedges tightly enough into the top opening of the container and wedges against the sidewall adjacent that opening, so as to both form a fluid tight seal that does not leak during use, but that also does not move out of engagement with the container as the force of the fluid 82 in the container hits the bottom of the dispersing disk 46 during use. As the container can be sized to hold various amounts of carbonated beverages, the force trying to push the cap 32 and its ring seal 34 out of the container 20 as the container is tilted or even inverted for pouring, can be several pounds. It is believed suitable to design the ring seal 34 to withstand a force of about 1 kg for a container having an opening in its top about 60 mm in diameter. The 1 kg force corresponds roughly to the weight of 1 liter of fluid in the container 20. For containers of sufficiently different dimensions, especially for larger ones, different dimensions for the seal may be used.

The container 20 may be made of any suitable material, including metals such as aluminum or stainless steels, or made of glass, or made of suitable polymers such as food grade plastics, including ABS plastic. The height of the container 20 is advantageously selected to hold sufficient fluid 82 for the immediate needs, as prolonged retention of carbonated beverages in the container allow the carbonization to escape. The depicted container is shown without a handle, but such handles could be provided and molded integrally with the container 20, or clamped around the top of the container with a band. The container 20 is shown as having a sidewall tapered from the bottom 22 to the lip 30 surrounding the top opening of the container. The container may have a cylindrical neck extending downward a distance corresponding to the axial length of the seal 34 or slightly longer. The cap's bottom lip 38 and the juncture of the cylindrical neck with the sidewall 24 should be configured to allow the described laminar flow to be achieved between the juncture of the cap 32 and the cylindrical neck or sidewall 24 of the container, which should not be difficult given the present disclosure and the skill in the relevant art.

Referring to FIGS. 1-2, the dispersing disk 46 is shown with a curved protrusion 50 centered on longitudinal axis 26. The dispersing disk 46 advantageously has a smooth top surface, with the protrusion configured to spread the stream 80 of fluid 82 while reducing and advantageously preventing splashing. Protrusions having a conical or frusto-conical shape (with or without rounded tops on the truncated ends) are believed suitable. Protrusions 50 having continuously curved cross-sections in three dimensions as shown in FIGS. 1-2 are believed preferable to reduce turbulence and direct the flow of the fluid stream 80 more uniformly around the periphery of the dispersing disk 46. Protrusions 50 having sides that are concave with respect to axis 26 and form circles of revolution are believed suitable. Protrusions 50 having flat sides inclined downward and outward are also believed suitable. Thus, the depicted shape of protrusion 50 is not limited to the depicted shape. Moreover, as shown in FIG. 10, the protrusion 50 can be omitted.

The supports 48 are shown as L-shaped supports, with one support opposite the spout 44 and the other two diametrically opposite each other and about 90° from the support that is opposite the spout. That arrangement removes flow obstructions from the flow path out of the container through the spout 44. But it also leaves half of the dispersing disk 46 unsupported and effectively cantilevered from the three supports connected around the periphery of half the dispersing disk 46. Other configurations of the supports 48 may be provided, including different numbers of such supports and different configurations.

In the depicted embodiment of FIGS. 1-2, the axial distance from the top of the dispersing disk 46 to the bottom of the first shoulder 40 is about 9 mm in the depicted embodiment of FIGS. 1-2.

The cap's splashguard 42, shoulders 40, 41, bottom ring portion 36 and its lip 38, are advantageously formed by stamping from a sheet of metal or preferably integrally and simultaneously molded as a unitary piece of a suitable plastic. The dispersing disk and supports 48 are advantageously made of the same material as the splashguard 42 and bottom, ring portion 36. If formed of metal, the supports 48 are spot welded to the inside of the bottom, ring portion 36 and to the dispersion disk 46, preferably to the bottom of the disk so as not to disrupt the flow across the top of the disk. If formed of plastic, the supports 48 may be adhered or friction bonded to the bottom, ring portion 36 and the dispersing disk 46. Other connection mechanisms can be used.

The depicted ring seal 34 is advantageously a rubber or elastomeric material compatible with consumable beverages of all types, with neoprene and silicon believed suitable. The depicted ring seal 34 advantageously has an inner diameter slightly larger than the outer diameter of the bottom, ring portion 36 of the cap 32 to help hold the ring seal in place between the shoulder 40 and lip 38 on opposing top and bottom sides of the ring portion 36. The ring seal 34 is advantageously sufficiently stretchable for its diameter that it may be moved along axis 26 to move over the bottom lip 38 so the inner seal wall 60 encircles and clamps against the ring portion 36 of the cap.

The depicted ring seal 34 is believed advantageous for use because it can seal against an inclined sidewall 24, or sidewalls if the sidewall takes the form of multiple flats instead of a continuous curve in planes orthogonal to the longitudinal axis 26. But other types of annular seals may be used, including a single O-ring seal, or multiple O-ring seals spaced axially along axis 26 and partially retained in annular grooves in the inner wall of the ring seal 34. Other types of ring seals may be used instead of O-rings, including D-rings.

FIGS. 8-10 and 14-16 show the container 20 with a cap 32 having a flat dispersing disk 46 that has no center protrusion 50. This flat dispersing disk 46 and container 20 work just as described for the cap of FIGS. 1-2, except for the flow differences created by the lack of the protrusion. The flat dispersing disk 46 is more susceptible to splashing if the stream 80 hits perpendicular to the disk 46. Splashing may be reduced by inkling the stream 80 of fluid to hit the dispersing disk 46 at an inclined angle to the surface and inclined relative to axis 26. But the inclined stream 80 directs more fluid 82 to the side of the distribution disk opposite the inclined stream so the flow around the outer periphery of the disk may not be as uniform as when the stream 80 flows along the axis 26. Depending on the flow rate and velocity of the stream 80, the flat dispersion disk 46 is believed suitable for use, and is believed suitable for use at flow rates of up to 1.5-2 gpm when the spigot is less than 12 inches from the dispersing disk.

The ring seal 34 is advantageously a rubber or elastomeric material compatible with consumable beverages of all types, with neoprene and silicon believed suitable.

The cap 32 and the dispersing disk 46 are configured to reduce loss of carbonation in the stream 80 and fluid 82 as the container 20 is filled, compared to the carbonation lost if the stream 80 of carbonized fluid 82 were simply poured from a bottle or dispensed from a spigot from the same height into the container 20 with the cap removed. Reductions of loss of carbonation of at least 20% are believed common, with reductions of 10% or less believed achievable with the cap 32 and dispersing disk 46 are used, compared to the loss of carbonation if the cap and dispersal disk are not used, with the loss due to the splashing and the turbulence effect inside the fluid while the container is filled. Stated differently, if the dispensed stream 80 of carbonized fluid has 8 grams per liter dissolved carbon dioxide in the stream 80, use of the container 20 and cap 32 with its dispersing disk 46 is believed to result in a reduction of carbonation of 5% to 10% of that carbon dioxide when dispensing the stream 80 at a flow rate of 1.5 gpm from a height of up to 14 inches above the container bottom 22, and a height of 4 inches above the dispensing disk 46. It is believed that the dispensing flow rate for most containers may vary from 0.3 to 1 gpm (gallons per minute), while the cap and dispensing disk described herein is configured to reduce carbonation loss as described herein at flow rates of up 2 gpm, while a flow rate of 1.5 gpm is believed desirable. It is believed dispensing the same stream 80 in to the container 20 from the same height of 14 inches without the cap 32 and the disk 46 will result in a reduction of carbonation of 15% to 25%, with an average reduction of 20%.

Because the sidewall 24 of the container 20 is inclined, the distance to the sidewall 24 in a plane orthogonal to the longitudinal axis will vary, preferably increasing in the downward direction. If the length of the container 20 varies, then the resulting size of the container opening will vary if the container bottom 22 is the same for different axial lengths or heights of containers 20. That requires a different ring seal 34 and cap 32 for containers with differing heights and volumes.

The number of different sized caps 32 and rings seals 34 may be reduced by keeping the size of the container opening encircled by the lip 30 the same, or to a limited number of opening dimensions. The length of the container 20 may be measured from the top downward, with the length cut to achieve the desired volume of the container—but measured from the top at lip 30, not measured from the bottom. A bottom 22 may be formed much easier and at less cost than the cap 32 and ring seal 34. If made of glass, a container may be cut to length after measuring the length from the open top sized to receive the ring seal of the cap, and the cut bottom can be mated with a bottom 22 of appropriate size. Alternatively, a mold for either glass or plastic can be formed to achieve the desired length and volume of the container 20, but with the container opening the same size which is selected to form a fluid tight seal with the cap 32 and its seal ring 34.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Moreover, while the above description is for specific use with carbonated fluids such as carbonated water and carbonated soft drinks, the cap 32 and container 20 are not limited to such use, and may be used with other carbonated fluids such as beer, and use with non-carbonated fluids, including, but not limited to fruit juices, still water and alkaline water.

The above container 20 has a circular opening and the ring seal 34 supported on the ring portion 36 are configured to fit into that circular opening, and the dispersing disk 46 and splashguard 42 have has a circular shape so that the fluid 82 flows smoothly and preferably in a laminar flow between the periphery of the dispensing disk 46 and the nearby splashguard 42 and spout 44. But the container's opening need not be circular and may be other shapes, including but not limited to triangular, square, hexagonal or other multi-sided shapes. In such cases the sealing ring would be configured to seal against the multi-sided opening in the container, the ring portion 36 would be configured to conform to the sealing ring shape and container opening shape (as would the shoulders 40, 41, ring portion 36 and its lip 38), the splashguard 42 and spout 44 would be configured to conform to the multi-sided shape of the ring portion 36 and first shoulders 40, as would the dispersing disk 46 and protrusion 50, such that laminar flow is achieved for that flow occurring downward of the first shoulder 40 and preferably downward of the dispersing disk 46 when the container is being filled. Thus, the present invention is not limited to circular openings in containers 20, but may have multi-sided shapes. The same applies to non-circular but openings continuously curved about a longitudinal axis, such as oval, elliptical openings.

The above description is given by way of example, and not limitation. Given the above disclosure, one skilled in the art could devise variations that are within the scope and spirit of the invention, including various ways of varying the dimensions as the length and diameter of the impeller varies. Further, the various features of this invention can be used alone, or in varying combinations with each other and are not intended to be limited to the specific combination described herein. Thus, the invention is not to be limited by the illustrated embodiments.

What is claimed is:

1. An apparatus for receiving a fluid in, and dispensing that fluid from, a container that extends along a longitudinal axis and has a container lip defining a container opening at a top of the container opposite a closed container bottom, the apparatus comprising:

a cap, including:

a splashguard at a top end of the cap and encircling a majority of the longitudinal axis during use; and a ring portion with a bottom lip at a bottom end of the cap, the bottom lip extending outward and downward, the ring portion and bottom lip encircling the longitudinal axis during use;

a continuous dispersing disk connected to the cap and located above the ring portion and inside the splashguard, the dispersing disk having an outer disk periphery which disk periphery is spaced a distance from the splashguard of between 2 and 5 mm so the fluid can flow from the dispersing disk to the splashguard and downward along the splashguard and through the ring portion; and a ring seal connected to an outward facing side of the ring portion, the ring seal having a shape corresponding to that of the container opening and sized to contact and seal against the container opening during use.

2. The apparatus of claim 1, wherein the dispersing disk has a shaped protrusion extending upward along the longitudinal axis, the shaped protrusion having a cross-section in a plane orthogonal to the longitudinal axis that is smaller at the top and larger at the bottom to redirect a stream of fluid moving downward along the longitudinal axis, outward toward the outer periphery of the dispersing disk.

3. The apparatus of claim 1, wherein the dispersing disk has a shaped protrusion extending upward and forming a circle of revolution that directs fluid flowing downward along the longitudinal axis to move in an outward direction and has a cross-section in a plane orthogonal to the longitudinal axis that is smaller at the top and larger at the bottom.

4. The apparatus of claim 1, wherein the dispersing disk is circular and has an upward facing surface that is flat.

5. The apparatus of claim 1, wherein the portion of the cap below the bottom of dispersing disk is configured to cause laminar flow of carbonated water having no dissolved sugar, at a flow rate of up to 1.5 gpm across a major portion of the ring portion in the downward direction.

6. The apparatus of claim 1, wherein the portion of the cap below the bottom of dispersing disk is configured to cause laminar flow of carbonated water having no dissolved sugar, at a flow rate of up to 1.5 gpm across a substantial majority of the ring portion in the downward direction.

7. The apparatus of claim 1, wherein the splashguard further includes a pouring spout.

8. The apparatus of claim 1, wherein a substantial majority of the splashguard that is radially outward and downward of the dispersing disk is cylindrical and wherein the ring portion has a cylindrical inward facing surface that is the same diameter as that substantial majority of the splashguard.

9. The apparatus of claim 1, wherein the splashguard has a bottom shoulder extending inward and downward and wherein the ring portion has an upper shoulder extending outward and upward to connect with the bottom shoulder of the splashguard, the ring portion having an inward facing surface that is radially inward of the outer periphery of the dispersing disk.

10. The apparatus of claim 9, wherein the portion of the cap below the bottom of dispersing disk is configured to cause laminar flow of a carbonated beverage at a flow rate of up to 1.5 gpm across a substantial majority of the ring portion in the downward direction.

11. The apparatus of claim 1, wherein the ring portion has an inward facing surface that is cylindrical and that is located radially inward of the outer periphery of the dispersing disk, with the inward facing surface of the cap between the dispersing disk and the bottom of the ring portion configured to achieve a laminar flow of water at a flow rate of up to 1.5 gpm across a majority of the ring portion.

12. The apparatus of claim 11, wherein the cylindrical, inward facing surface is below the top surface of the dispersing disk an axial distance of between 5 to 15 mm, measured at the outer periphery of the dispersing disk.

13. The apparatus of claim 1, wherein the splashguard has a bottom shoulder extending inward and downward and wherein the ring portion has an upper shoulder extending outward and upward to connect with the bottom shoulder of the splashguard, the ring portion having an inward facing surface that is radially inward of the outer periphery of the dispersing disk.

14. The apparatus of claim 1, wherein the ring portion has an inward facing surface that is cylindrical, that is located radially inward of the outer periphery of the dispersing disk a distance of 1 mm to 10 mm, and that is below the top surface of the dispersing disk at the outer periphery of that disk an axial distance between 5 to 15 mm.

15. The apparatus of claim 1, wherein the ring seal comprises four annular flanges extending outward from an inner wall of the sealing ring, the four annular flanges including top and bottom flanges, a first intermediate flange that is adjacent the bottom flange, and a second intermediate flange extending radially outward while the top, bottom and first intermediate flange extend outward and upward.

16. The apparatus of claim 15, wherein the first and second flanges extend upward at an angle of substantially 10° and extend radially outward a distance that is 15% to 35% greater than the length of the radial flange and top flange.

17. The apparatus of claim 1, wherein the ring seal comprises a plurality of annular flanges encircling the ring seal and extending outward from an inner wall of the seal ring a distance sufficient to contact the container during use, the flanges including first, second, third and fourth flanges with the first flange at the bottom of the ring seal and the second flange above the first flange and the third flange above the second flange and the fourth flange at the top of the ring seal, the first and second flanges extending upward at an angle of 8° to 12° to the vertical and having a length of 0.1 to 0.2 inches along their upwardly extending length, the third flange extending radially and the fourth flange extending upward at an angle of 20° to 30° to the vertical, the third and fourth flanges extending outward from the inner wall of the seal ring a radial distance that is 5% to 30% less than the corresponding radial distance of the first and second flanges.

18. The apparatus of claim 1, further comprising the container with the sealing ring of the cap inserted into and forming a seal with the container opening, the container having a container sidewall.

19. The apparatus of claim 18, wherein the container sidewall is inclined outward at an angle of less than 5° relative to the vertical so the cross-section of the container in a plane orthogonal to the longitudinal axis increases toward the bottom of the container, and wherein the cross-section increases along a majority of the axial length of the container.

20. An apparatus for receiving a fluid in, and dispensing that fluid from, a container that extends along a longitudinal axis and has a container lip defining a container opening at a top of the container, the container having a closed container bottom, the apparatus comprising:

a cap having a laminar flow path through a lower portion of the cap, the cap including:

a splashguard at a top end of the cap and encircling the longitudinal axis during use; and a ring portion at a bottom end of the cap, the ring portion having a bottom lip extending outward and downward from the bottom of an inward facing flow surface, the ring portion having a top connected to a bottom of the splashguard, the bottom lip, flow surface and top of the ring portion all encircling the longitudinal axis and forming a portion of the laminar flow path;

a continuous dispersing disk inside the splashguard and connected to the cap, the dispersing disk being above the connection of the splashguard with the top of the ring portion, the dispersing disk facing upward and having an outer disk periphery spaced a radial distance of 2 to 5 mm from the splashguard and spaced an axial distance of 4 to 10 mm above the top of the ring portion so the fluid can flow from the dispersing disk at up to 1.5 gpm outward to the splashguard during use, with a substantial portion of the fluid flowing in a laminar flow downward across the connection of the splashguard and the ring portion and across the bottom lip; and a ring seal connected to the cap and having a shape and size corresponding to that of the container opening, to contact and seal against the container opening during use.

21. The apparatus of claim 20, wherein the inward facing flow surface of the ring portion is cylindrical and coaxial with the longitudinal axis, and the connection between the ring portion and the splashguard comprises a conical section and the splashguard has a circular cross-section in a plane orthogonal to the longitudinal axis at the location of the dispersing disk.

22. The apparatus of claim 21, wherein the dispersing disk has a flat surface.

23. The apparatus of claim 21, wherein the dispersing disk has a shaped protrusion on the upper surface of the dispersing disk with a cross-sectional diameter that decreases in a downward direction to direct the flow of fluid flowing downward along the longitudinal axis in an outward direction around a majority of the dispersing disk.

24. The apparatus of claim 23, wherein the dispersing disk is connected to the cap by a plurality of supports extending from the ring portion to the dispersing disk.

25. The apparatus of claim 24, wherein the splashguard includes a pouring spout.

26. The apparatus of claim 25, further including the container with the seal placed in the opening of the container, and wherein the container has a sidewall extending along the longitudinal axis, with the sidewall increasing in cross-sectional area along a majority of the length between the container opening and the bottom of the container, with the sidewall inclined at an angle to the vertical of less than 5° so that the container cross-section in the plane orthogonal to the longitudinal axis is smaller at the top of the container than at the bottom, with the lip and bottom of the seal forming a portion of a laminar flow path extending through the cap and into the container.

27. A kit, including the cap of claim 23, and further including the container, and wherein the container has a sidewall extending along the longitudinal axis, with the sidewall increasing in cross-sectional area along a majority of the length between the container opening and the bottom of the container, with the sidewall inclined at an angle to the vertical of less than 5° with the lip and bottom of the seal forming a portion of a laminar flow path when the cap is placed on the container and the seal is placed in the container opening to seal that opening.

* * * * *